US010175599B2

(12) United States Patent
Nonaka et al.

(10) Patent No.: US 10,175,599 B2
(45) Date of Patent: Jan. 8, 2019

(54) ROTATING MEMBER, PROCESS CARTRIDGE, AND IMAGE FORMING APPARATUS

(71) Applicant: CANON KABUSHIKI KAISHA, Tokyo (JP)

(72) Inventors: Fumito Nonaka, Mishima (JP); Makoto Hayashida, Numazu (JP); Hiroomi Matsuzaki, Mishima (JP); Hiraku Sasaki, Susono (JP); Issei Imamura, Mishima (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/630,031

(22) Filed: Jun. 22, 2017

(65) Prior Publication Data

US 2017/0371264 A1 Dec. 28, 2017

(30) Foreign Application Priority Data

Jun. 28, 2016 (JP) ..... 2016-127928
May 30, 2017 (JP) ..... 2017-106477

(51) Int. Cl.
*G03G 15/02* (2006.01)

(52) U.S. Cl.
CPC ..... *G03G 15/0233* (2013.01)

(58) Field of Classification Search
CPC . G03G 15/0233; G03G 15/0818; B41J 13/02; B41J 13/076; F16C 3/02
See application file for complete search history.

(56) References Cited

U.S. PATENT DOCUMENTS

| | | | | |
|---|---|---|---|---|
| 9,180,702 | B2 * | 11/2015 | Saito | F16C 3/02 |
| 9,423,715 | B2 | 8/2016 | Kamata et al. | |
| 9,500,977 | B2 | 11/2016 | Matsuzaki et al. | |
| 2017/0219962 | A1 | 8/2017 | Sasaki et al. | |

FOREIGN PATENT DOCUMENTS

| | | | |
|---|---|---|---|
| JP | 2003-053460 | A | 2/2003 |
| JP | 2005-007406 | A | 1/2005 |
| JP | 2010-230736 | A | 10/2010 |
| JP | 2010-230748 | A | 10/2010 |
| JP | 2013-109209 | A | 6/2013 |

OTHER PUBLICATIONS

Copending, unpublished U.S. Appl. No. 15/623,861, dated Jun. 15, 2017.

* cited by examiner

*Primary Examiner* — Hoang Ngo
(74) *Attorney, Agent, or Firm* — Venable LLP

(57) ABSTRACT

One end portion and the other end portion of a rotating member, which face each other and form a joint portion, have a shape with projections and recesses. Projections of one end portion fit in recesses of the other end portion, while projections of the other end portion fit in recesses of the one end portion, so that the one end portion and the other end portion are interlocked. The projections have a first corner portion rounded in an arc, while the recesses have a second corner portion rounded in an arc in which the first corner portion fits. The first corner portion has a larger radius of curvature than that of the second corner portion.

13 Claims, 25 Drawing Sheets

ROTATING MEMBER, PROCESS CARTRIDGE, AND IMAGE FORMING APPARATUS

BACKGROUND OF THE INVENTION

Field of the Invention

The present invention relates to a rotating member used for forming an image on a recording medium, a process cartridge that forms a developer image on a photosensitive drum and is removably mounted to a main body of an image forming apparatus, and an image forming apparatus that forms an image on recording media with a developer.

Description of the Related Art

Electrophotographic image forming apparatuses have conventionally employed a process cartridge system wherein a photosensitive drum and a process means that acts on the photosensitive drum are integrated as a process cartridge. In such a process cartridge system, the process cartridge is removably mounted to the main body of the image forming apparatus. The process cartridge system enables easy maintenance of image forming apparatuses, as it allows users to do the maintenance by themselves and not by servicemen. For this reason, the process cartridge system is used in many image forming apparatuses. Most process cartridges include a photosensitive drum, a charging roller that charges the photosensitive drum, a developing apparatus that develops an electrostatic latent image formed on the photosensitive drum, and a cleaning member that cleans toner that was not transferred onto the recording medium and remained on the surface of the photosensitive drum.

The charging roller is a conductive elastic roller and abuts the surface of the photosensitive drum. Voltage is applied to the charging roller in this state, whereby the charging roller charges the surface of the photosensitive drum. In the technique disclosed in Japanese Patent Application Laid-open No. 2013-109209, the charging roller includes a metal rotating shaft and an elastic layer that covers the rotating shaft. More specifically, both ends of the rotating shaft are exposed and other parts are covered by the elastic layer.

In the technique disclosed in Japanese Patent Application Laid-open No. 2010-230748, the metal rotating shaft of the charging roller is hollow. More specifically, the hollow rotating shaft is formed by interlocking continuously toothed ends of one sheet metal, with the projections on one end fitting in the recesses on the other end, and the projections on the other end fitting in the recesses on one end. In the technique disclosed in Japanese Patent Application Laid-open No. 2010-230748, the projections and recesses on both ends of the sheet metal have a trapezoidal shape.

If the joint part of both ends of the sheet metal is not toothed but straight, the hollow rotating shaft may suffer deflection or twist, as a result of which the elastic layer of the charging roller may fail to uniformly contact the surface of the photosensitive drum and fail to evenly charge the surface of the photosensitive drum. This may result in image defects. Therefore, according to the technique disclosed in Japanese Patent Application Laid-open No. 2010-230748, the joint part of both ends of the sheet metal is continuously toothed so as to improve the strength of the hollow rotating shaft. The continuous toothed shape of the joint part of both ends of the sheet metal increases the frictional force between one end and the other end of the sheet metal, whereby the torsional rigidity of the hollow rotating shaft is increased. However, in the technique disclosed in Japanese Patent Application Laid-open No. 2010-230748, if there are dimensional errors in the projections and recesses that may be rectangular or trapezoidal, corner portions on the rectangular or trapezoidal projections and corner portions in the corresponding recesses may not properly contact each other. The projections and recesses will then fail to fit together correctly, as a result of which the torsional rigidity of the hollow rotating shaft may be lowered.

SUMMARY OF THE INVENTION

An object of the present invention is to minimize a reduction in strength of a hollow rotating shaft that has a joint part.

To achieve the object noted above, the rotating member of the present invention is a rotating member used for forming an image on a recording medium and has a cylindrical rotating shaft, wherein the rotating shaft having a joint portion which extends from one end to the other end of the rotating shaft in an axial direction of the rotating shaft and in which end portions of the rotating shaft face each other in a circumferential direction of the rotating shaft, one end portion and the other end portion, which face each other and form the joint portion, having a shape with projections and recesses, projections of the one end portion fitting in recesses of the other end portion, while projections of the other end portion fitting in recesses of the one end portion, so that the one end portion and the other end portion are interlocked, the projections having a first corner portion rounded in an arc, the recesses having a second corner portion rounded in an arc in which the first corner portion fits, and the first corner portion having a larger radius of curvature than that of the second corner portion.

To achieve the object noted above, the rotating member of the present invention is a rotating member used for forming an image on a recording medium and has a cylindrical rotating shaft, wherein the rotating shaft having a joint portion which extends from one end to the other end of the rotating shaft in an axial direction of the rotating shaft and in which end portions of the rotating shaft face each other in a circumferential direction of the rotating shaft, one end portion and the other end portion, which face each other and form the joint portion, having a shape with projections and recesses, projections of the one end portion fitting in recesses of the other end portion, while projections of the other end portion fitting in recesses of the one end portion, so that the one end portion and the other end portion are interlocked, the projections being provided with a first corner portion, the recesses being provided with a second corner portion opposite the first corner portion, wherein a gap is formed between the first corner portion and the second corner portion.

To achieve the objected noted above, the process cartridge of the present invention is a process cartridge removably mounted to a main body of an image forming apparatus and forming a developer image, and includes:

the rotating member noted above;

an image bearing member on which a developer image is formed; and a developing apparatus that develops an electrostatic latent image formed on the image bearing member, wherein the image bearing member is charged by the rotating member, the charged image bearing member is exposed so that an electrostatic latent image is formed on the image bearing member, and the electrostatic latent image formed on the image bearing member is developed by the developing apparatus so that a developer image is formed on the image bearing member.

To achieve the objected noted above, the image forming apparatus of the present invention is an image forming apparatus forming an image on a recording medium and including:

the rotating member noted above;

an image bearing member on which a developer image is formed; and a developing apparatus that develops an electrostatic latent image formed on the image bearing member.

The image bearing member is charged by the rotating member.

The charged image bearing member is exposed so that an electrostatic latent image is formed on the image bearing member.

The electrostatic latent image formed on the image bearing member is developed by the developing apparatus so that a developer image is formed on the image bearing member.

The developer image formed on the image bearing member is transferred to a recording medium so that an image is formed on the recording medium.

The present invention can minimize a reduction in strength of a hollow rotating shaft that has a joint part.

Further features of the present invention will become apparent from the following description of exemplary embodiments with reference to the attached drawings.

DESCRIPTION OF THE EMBODIMENTS

An embodiment of the present invention will be hereinafter illustrated with reference to the drawings. Note, it is not intended to limit the scope of this invention to the following embodiment, and the sizes, materials, shapes, and relative arrangements or the like of constituent components described in the embodiment should be changed as required in accordance with the configurations and various conditions of the apparatus to which the invention is applied.

Embodiment

Below, one embodiment will be described in detail with reference to the drawings. In this embodiment, the direction of the rotating center axis of an electrophotographic photosensitive drum (hereinafter, drum 62) as an image bearing member will be referred to as longitudinal direction. One side of the longitudinal direction where the drum 62 receives a drive force from a main body A of an image forming apparatus S shall be a drive side (drive force receiving part 63*a* in FIG. 6), and the opposite side shall be a non-drive side.

Figure 2:
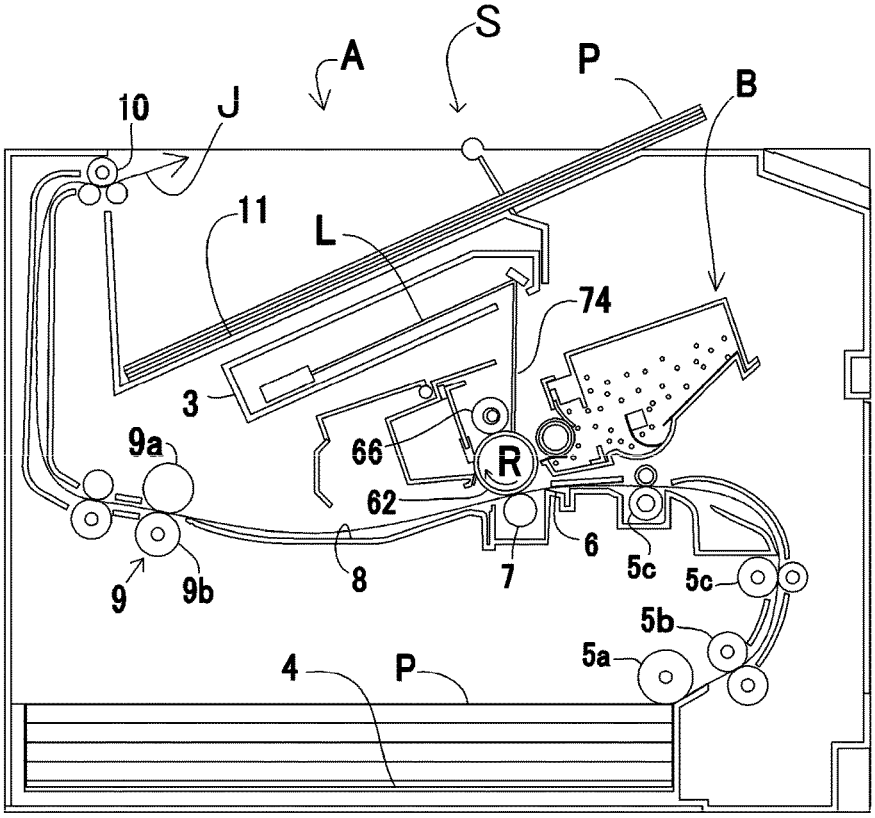
FIG. 2 is a schematic cross-sectional view of an image forming apparatus according to the embodiment.
Figure 3:
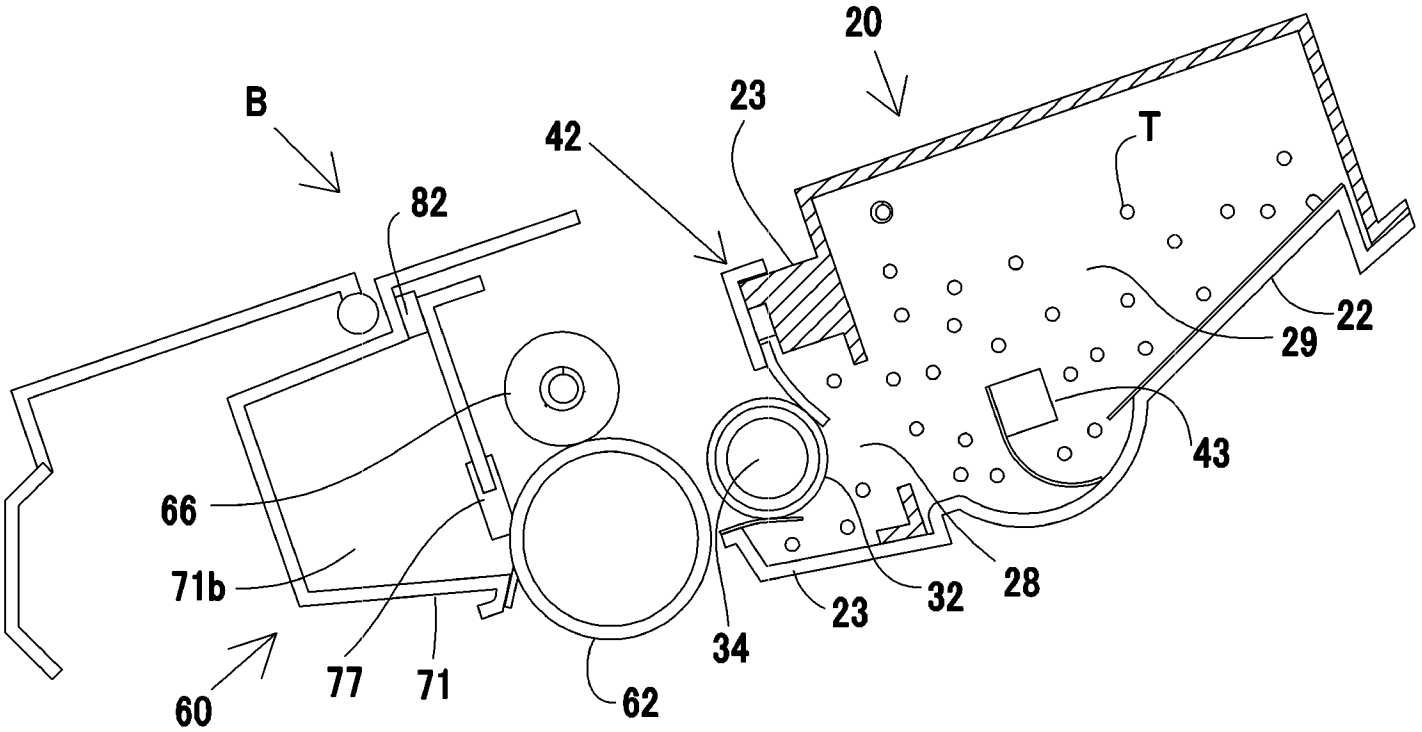
FIG. 3 is a schematic cross-sectional view of a cartridge according to the embodiment.
Figure 4:
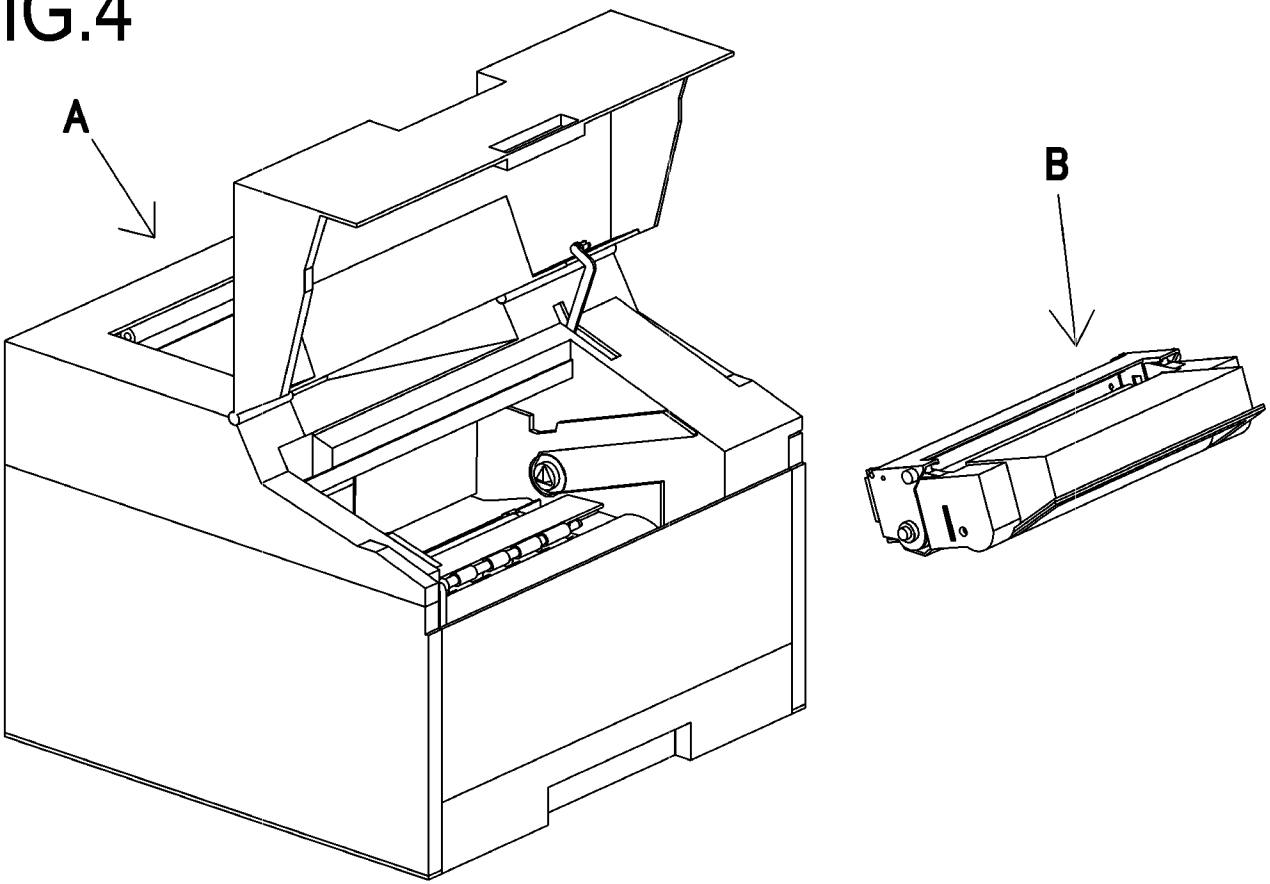
FIG. 4 is a diagram showing how the cartridge is mounted to the main body of an image forming apparatus.

The overall structure and the image forming process will be described with reference to FIG. 2, FIG. 3, and FIG. 4. FIG. 2 is a schematic cross-sectional view of the image forming apparatus S according to the embodiment. FIG. 3 is a schematic cross-sectional view of a cartridge B, which is a process cartridge according to the embodiment. FIG. 4 is a diagram showing how the cartridge B is mounted to the main body A of the image forming apparatus S. The main body A of the image forming apparatus S here means the part of the image forming apparatus S other than the cartridge B.

<Overall Structure of Image Forming Apparatus S>

The image forming apparatus S shown in FIG. 2 is a laser beam printer that utilizes electrophotography, and has the cartridge B removably mounted to the main body A. An exposure device 3 (laser scanner unit) for forming an electrostatic latent image on the drum 62 in the cartridge B is disposed in the image forming apparatus S. Below the cartridge B is disposed a sheet tray 4 where sheets P, which are a recording medium, are accommodated. A pickup roller 5*a*, a pair of feed rollers 5*b*, pairs of transport rollers 5*c*, a transfer guide 6, a transfer roller 7, a transport guide 8, a fixing apparatus 9, a pair of discharge rollers 10, a discharge tray 11, and the like are arranged sequentially along a transport direction J of the sheet P inside the main body A. The fixing apparatus 9 is made up of a heating roller 9*a* and a pressure roller 9*b*.

<Image Forming Process>

Next, the image forming process will be described. For an image process to be executed, the drum 62 is first driven to rotate in the direction of arrow R at a predetermined circumferential speed (process speed) based on a print start signal. The charging roller 66, which is a rotating member to which a bias voltage has been applied, contacts an outer circumferential surface of the drum 62 to uniformly charge the outer circumferential surface of the drum 62. The exposure device 3 outputs a laser beam L in accordance with image information. The laser beam L passes through an exposure window 74 in the cartridge B to scan and expose the outer circumferential surface of the drum 62. An electrostatic latent image is thus formed on the outer circumferential surface of the drum 62 in accordance with the image information.

Meanwhile, as shown in FIG. 3, in a developing apparatus unit 20, which is a developing apparatus, toner T inside a toner chamber 29 is stirred and transported by the rotation of a first transport member 43 and fed into a toner supply chamber 28. The toner T is then carried on the surface of a developing roller 32 by the magnetic force of a magnet roller 34 (fixed magnet). The toner T is charged by friction, and the toner layer thickness on the outer circumferential surface of the developing roller 32 is regulated, by means of a developing blade 42. The toner T adheres to the electrostatic latent image formed on the drum 62 so that the electrostatic latent image formed on the drum 62 is developed as a toner image, which is a developer image.

As shown in FIG. 2, a sheet P, accommodated in a lower section of the main body A, is moved out of the sheet tray 4 by the pickup roller 5*a*, pair of feed rollers 5*b*, and pairs of transport rollers 5*c* in sync with the output timing of the laser beam L. The sheet P is guided by the transfer guide 6 so that it is transported to a transfer position between the drum 62 and the transfer roller 7. The toner image is sequentially transferred from the drum 62 onto the sheet P at this transfer position.

Once the toner image has been transferred, the sheet P is separated from the drum 62, and guided by the transport guide 8 to be transported to the fixing apparatus 9. The sheet P passes through a nip portion between the heating roller 9*a* and the pressure roller 9*b* in the fixing apparatus 9. The toner image is fixed on the sheet P as the sheet P is pressed and heated at this nip portion. Once the toner image has been fixed, the sheet P is transported toward the pair of discharge rollers 10, so that it is discharged onto a discharge tray 11 by the pair of discharge rollers 10.

Meanwhile, as shown in FIG. 3, residual toner that remains on the surface of the drum 62 after the toner image has been transferred to the sheet P is removed by a cleaning blade 77, to be used again in another image forming process. The residual toner removed from the drum 62 is stored in a waste toner chamber 71*b* in the cleaning unit 60. The charging roller 66, developing roller 32, transfer roller 7, cleaning blade 77, and the like mentioned in the description above are the process means that act on the drum 62.

<Overall Structure of Cartridge B>

Figure 5:
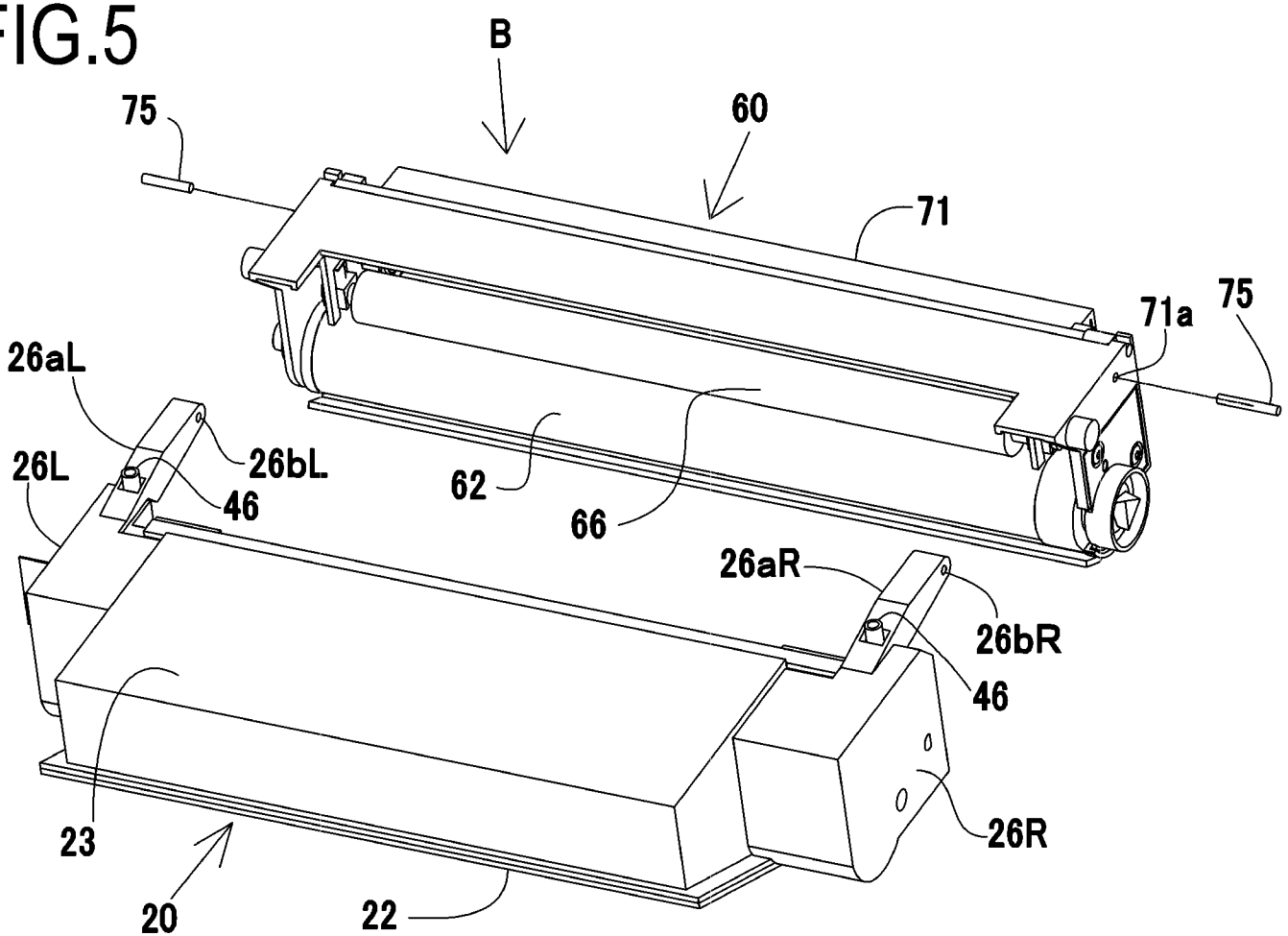
FIG. 5 is an exploded perspective view showing the structure of the cartridge according to the embodiment.

Next, the overall structure of the cartridge B will be described with reference to FIG. 3 and FIG. 5. FIG. 5 is an exploded perspective view showing the structure of the cartridge B according to the embodiment. The cartridge B is formed by uniting the cleaning unit 60 and the developing apparatus unit 20. The cleaning unit 60 is made up of a cleaning frame 71, the drum 62, charging roller 66, cleaning blade 77, and the like. The developing apparatus unit 20 is made up of a bottom member 22, a developer container 23, a first side member 26L, a second side member 26R, the developing blade 42, developing roller 32, magnet roller 34, transport member 43, toner T, biasing members 46, and the like.

The cartridge B is formed by coupling the cleaning unit 60 and the developing apparatus unit 20 so as to be rotatable relative to each other by means of coupling members 75. More specifically, arm parts 26*a*L and 26*a*R are formed on the first side member 26L and second side member 26R respectively at both ends in the longitudinal direction of the developing apparatus unit 20 (direction of the rotating center axis of the developing roller 32). Pivot holes 26*b*L and 26*b*R extending parallel to the longitudinal direction are provided at the tips of the arm parts 26*a*L and 26*a*R, respectively.

Fitting holes 71*a* are formed at both ends in the longitudinal direction of the cleaning frame 71 for fitting in the coupling members 75.

With the arm parts 26*a*L and 26*a*R set in predetermined positions relative to the cleaning frame 71, the coupling members 75 are inserted into the pivot holes 26*b*L, 26*b*R and fitting holes 71*a*. This way, the cleaning unit 60 and developing apparatus unit 20 are united such as to be rotatable around the coupling members 75. The biasing members 46 attached at the base of the arm parts 26*a*L and 26*a*R abut on the cleaning frame 71 so that the developing apparatus unit 20 is biased toward the cleaning unit 60 rotatably around the coupling members 75. Thus the developing roller 32 is firmly pressed toward the drum 62. Space retaining members (not shown) attached at both ends of the developing roller 32 keep a predetermined distance between the developing roller 32 and the drum 62.

<Structure of Cleaning Unit 60>

Figure 1:
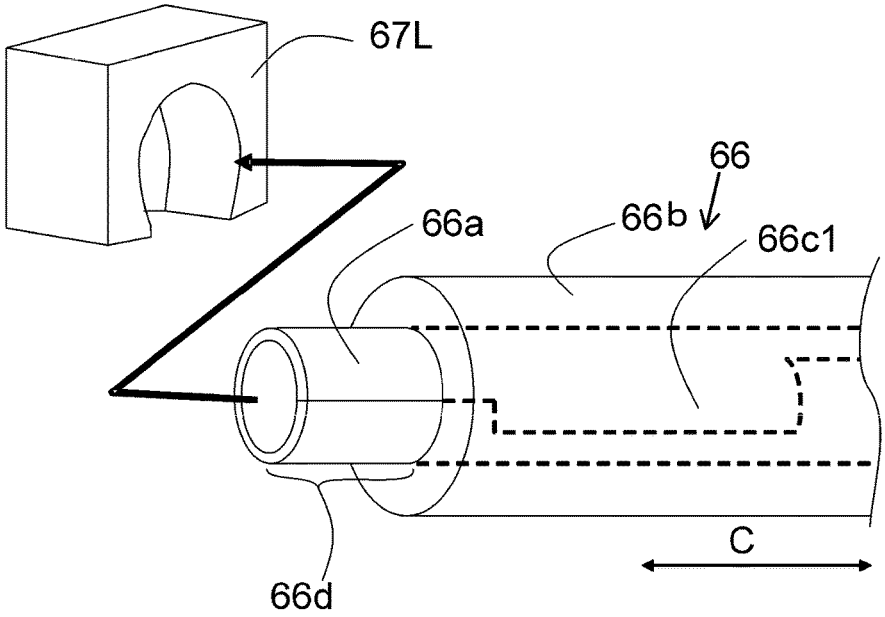
FIG. 1 is a perspective view of a charging roller and a charging roller bearing according to an embodiment.
Figure 6:
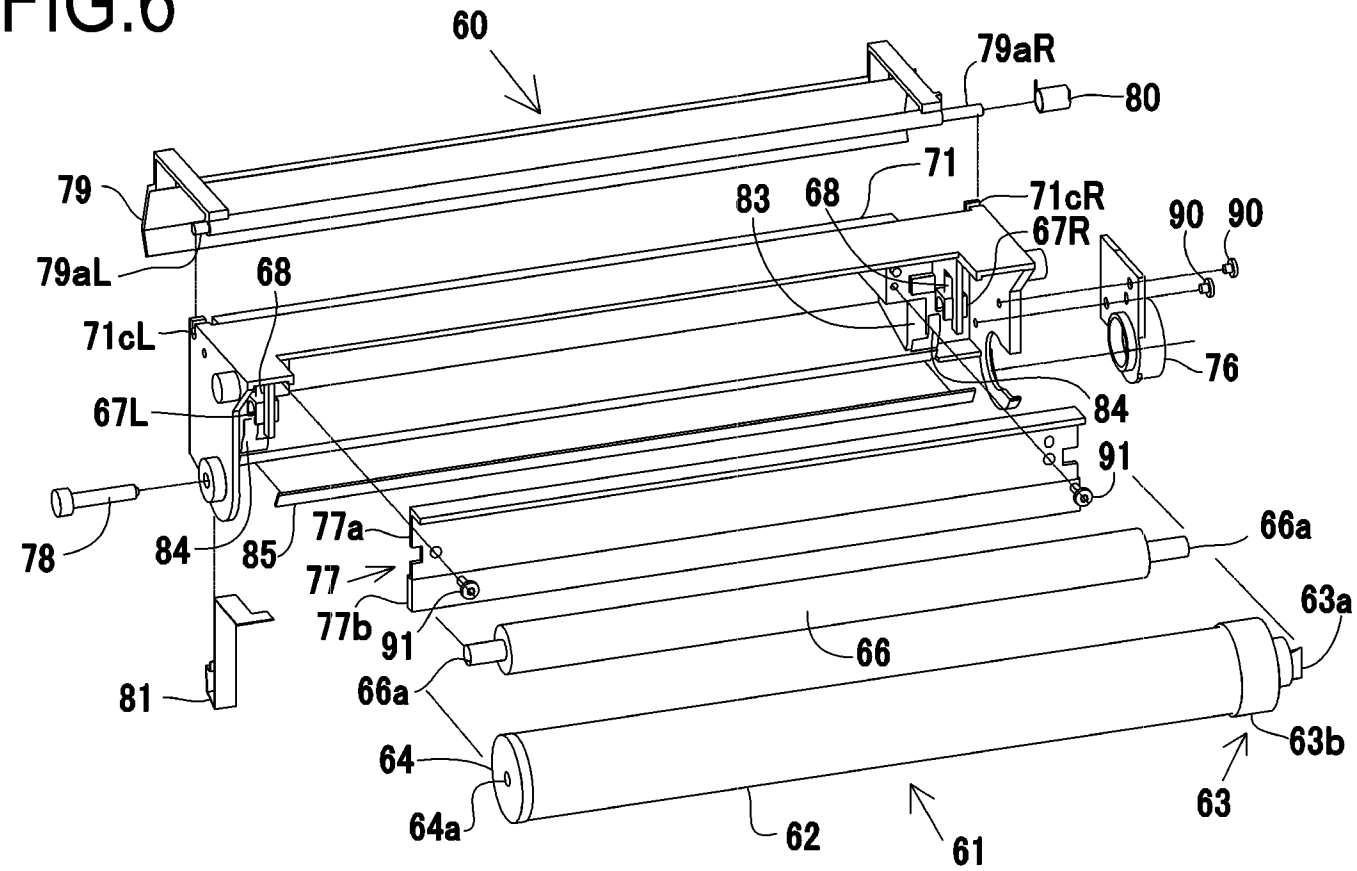
FIG. 6 is an exploded perspective view for explaining the structure of a cleaning unit according to the embodiment.
Figure 7A:
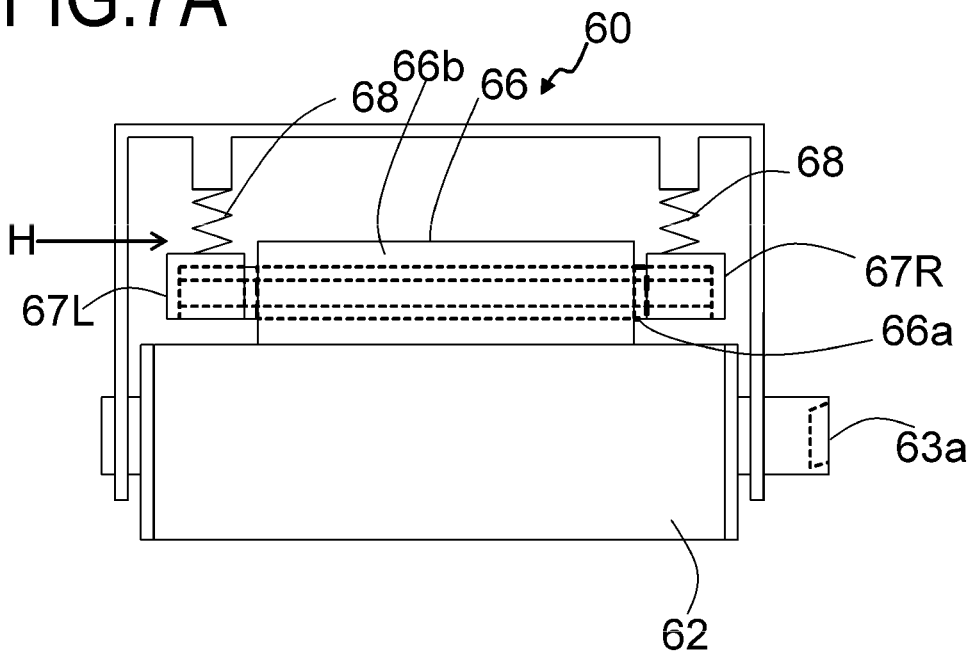
FIGS. 7A and 7B are diagrams showing the structure of the cleaning unit according to the embodiment.
Figure 7B:
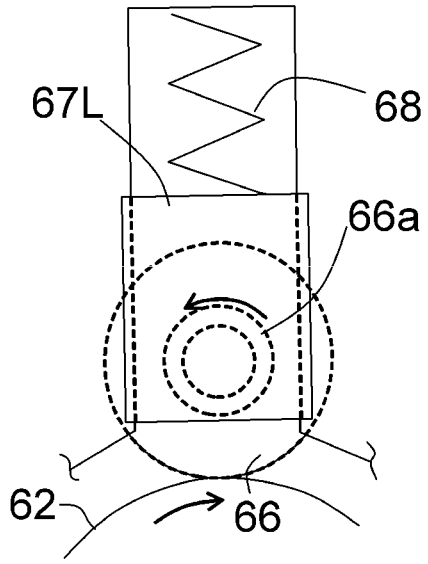
Figure 8:
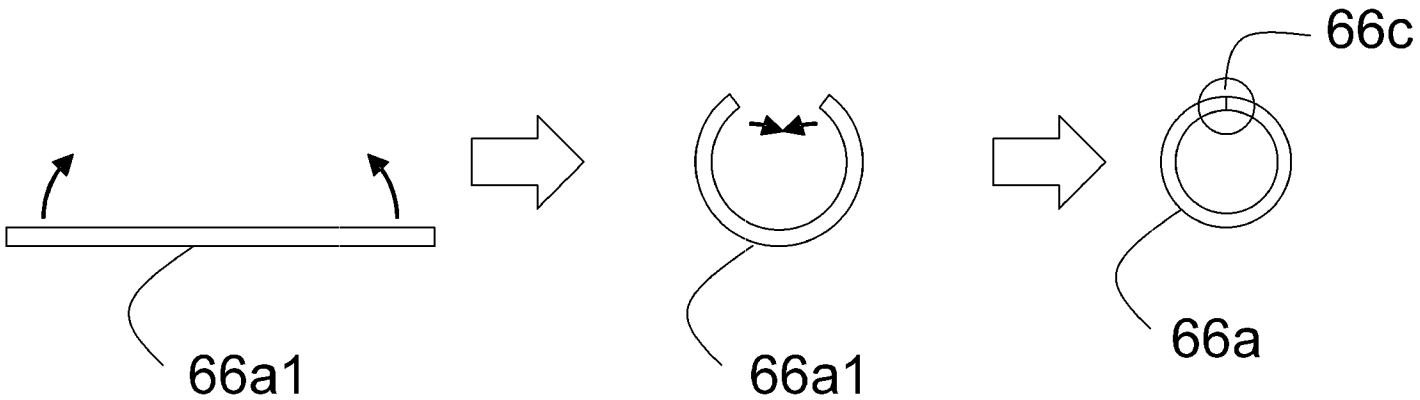
FIG. 8 is a cross-sectional view for explaining the process of fabricating the charging roller according to the embodiment.

Next, the structure of the cleaning unit 60 will be described with reference to FIG. 1, FIG. 6, FIG. 7, and FIG. 8. FIG. 1 is a diagram that shows the structure of the charging roller 66 and a charging roller bearing 67L. FIG. 6 is an exploded perspective view for explaining the structure of the cleaning unit 60 according to the embodiment. FIGS. 7A and 7B are diagrams showing the structure of the cleaning unit 60 according to the embodiment. FIG. 8 is a cross-sectional view for explaining the process of fabricating the charging roller 66 according to the embodiment. FIG. 7A is a front view for explaining the structure of the cleaning unit 60. FIG. 7B is a diagram of a part where the charging roller 66 is supported, as viewed from direction H in FIG. 7A.

As shown in FIG. 6, the cleaning blade 77 is made up of a support member 77*a* made of sheet metal, and an elastic member 77*b* made of an elastic material such as urethane rubber. The support member 77*a* of the cleaning blade 77 is fixed at both ends with screws 91 so that the support member 77*a* is secured at a predetermined position relative to the cleaning frame 71. The elastic member 77*b* contacts the drum 62 so that the residual toner is removed from the outer circumferential surface of the drum 62. The removed toner is stored in the waste toner chamber 71*b* (see FIG. 3) of the cleaning unit 60.

A first sealing member 82 (see FIG. 3), second sealing members 83, third sealing members 84, and a fourth sealing member 85 are fixed at predetermined positions relative to the cleaning frame 71 with a double sided tape or the like. The first sealing member 82 is provided to extend over the length of the support member 77*a* and prevents waste toner from falling out from the backside of the support member 77*a* of the cleaning blade 77. The second sealing members 83 prevent waste toner from falling out from both ends in the longitudinal direction of the elastic member 77*b* of the cleaning blade 77. The third sealing members 84 prevent waste toner from falling out from both ends in the longitudinal direction of the elastic member 77*b* of the cleaning blade 77, and wipe off substances such as toner adhered on the drum 62. The fourth sealing member 85 is provided to extend over the length of the drum 62 and in contact with the drum 62 to prevent waste toner from leaking from the upstream side of the rotating direction of the drum 62.

An electrode plate 81, biasing members 68, and the charging roller bearings 67L and 67R are attached to the cleaning frame 71. A metal shaft of the charging roller 66 (hereinafter, shaft part 66*a*) is fitted in the charging roller bearings 67L and 67R. The charging roller 66 is biased toward the drum 62 by the biasing members 68 as shown in FIGS. 7A and 7B, and supported rotatably by the charging roller bearings 67L and 67R. The charging roller 66 rotates passively with the rotation of the drum 62.

The hollow shaft part 66*a* of the charging roller 66 is covered entirely with a conductive elastic layer 66*b* except for both ends in the longitudinal direction. The elastic layer 66*b* and the shaft part 66*a* are joined with adhesive. The shaft part 66*a* is made by forming a stainless steel or SUM 22 sheet metal with a Ni-plated surface into a cylindrical shape by pressing. The hollow shaft part 66*a* formed by pressing is used here in order to reduce weight and cost of the cartridge B and image forming apparatus S.

The electrode plate 81, biasing members 68, charging roller bearing 67L, and shaft part 66*a* are conductive. The electrode plate 81 is in contact with a power feed unit (not shown) of the main body A. Power is fed to the charging roller 66 via these components as the power feed path. The drum 62 is integrally joined to flanges 64 and 63 to form a drum unit 61. Swaging, bonding, welding or the like is used to join the drum 62 to the flanges 63 and 64.

A ground connection point or the like (not shown) is joined to the flange 64. The flange 63 is provided with a drive force receiving part 63*a* that receives the drive force from the main body A and a flange gear part 63*b* for transmitting the drive force to the developing roller 32. The bearing member 76 is fixed to the drive side of the cleaning frame 71 with screws 90. The drum shaft 78 is press-fitted and fixed to the non-drive side of the cleaning frame 71. The bearing member 76 fits with the flange 63, while the drum shaft 78 fits into a hole 64*a* in the flange 64.

This way, the drum unit 61 is rotatably supported on the cleaning frame 71. A protection member 79 is rotatably supported on the cleaning frame 71 so that it is capable of both protecting (shielding) and exposing the drum 62. The biasing member 80 is attached to a shaft portion 79*a*R on the drive side of the protection member 79 so as to bias and cause the protection member 79 to protect the drum 62. The shaft portion 79*a*L on the non-drive side and the shaft portion 79*a*R on the drive side of the protection member 79 are fitted with bearing portions 71*c*L and 71*c*R of the cleaning frame 71, respectively.

<Structure of Charging Roller 66>

Figure 9A:
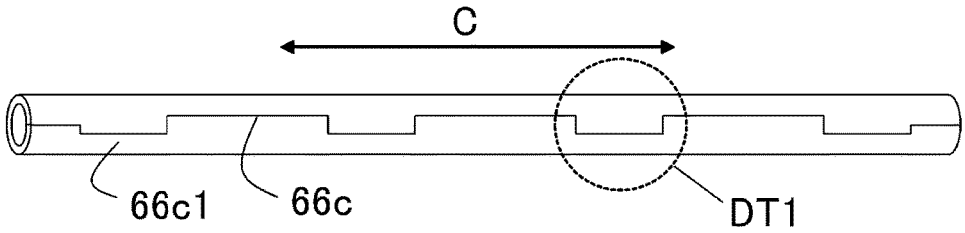
FIGS. 9A and 9B are diagrams showing the structure of a shaft part of the charging roller according to the embodiment.
Figure 9B:
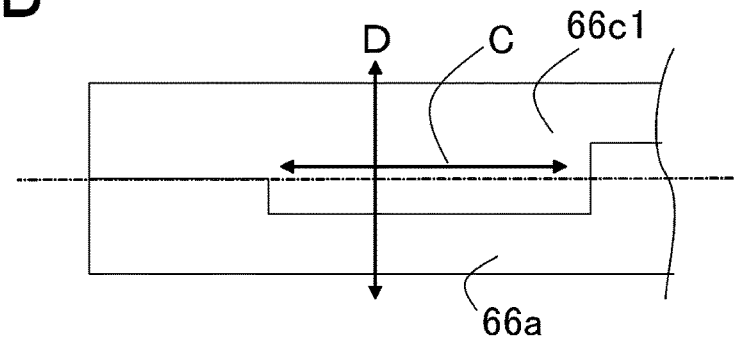
Figure 10:
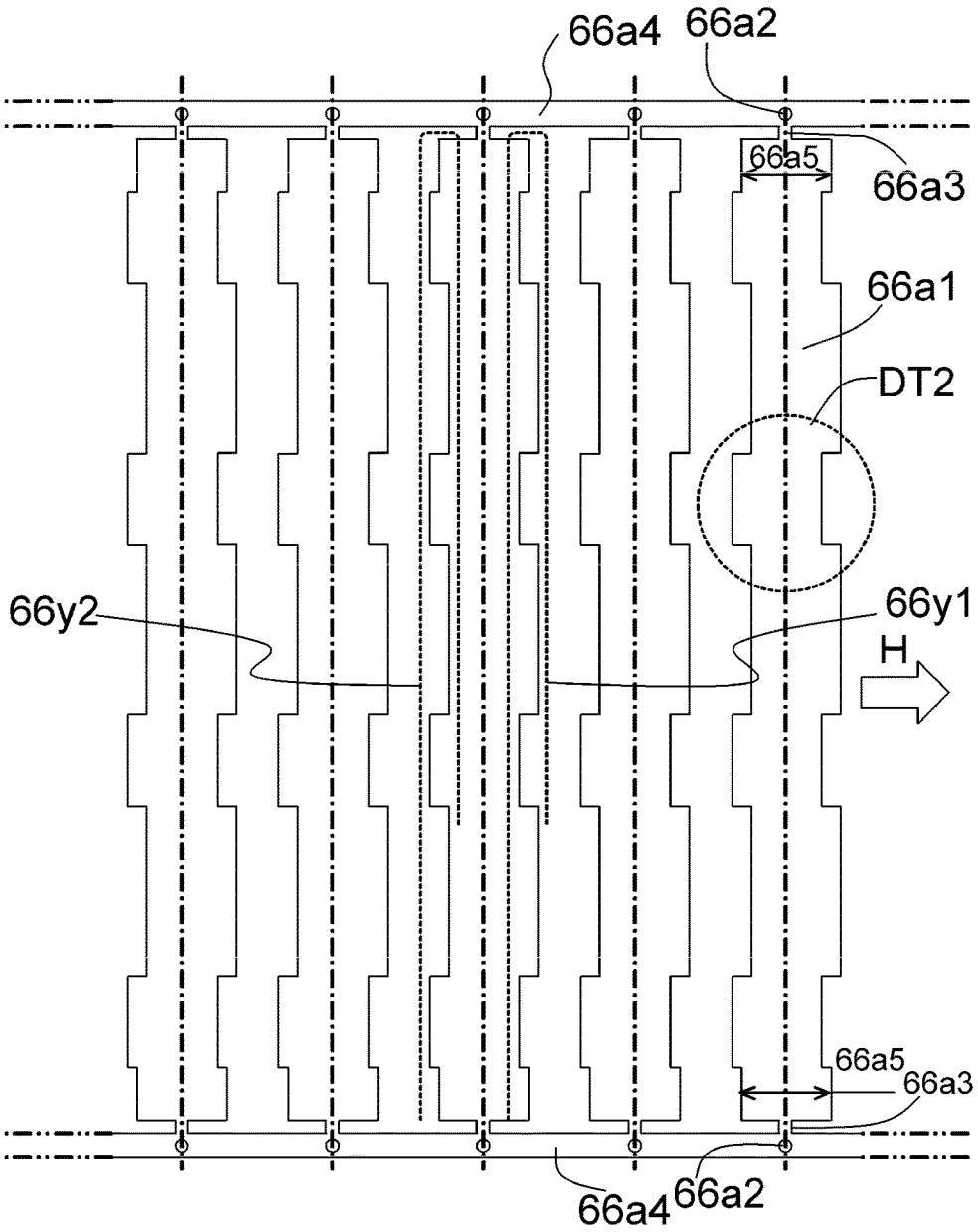
FIG. 10 is a diagram showing a sheet metal used to form the shaft part according to the embodiment.
Figure 11A:
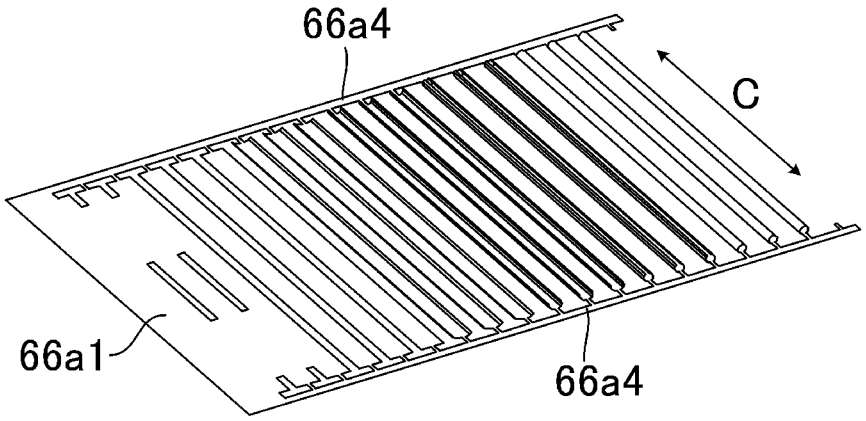
FIGS. 11A and 11B are diagrams showing how the sheet metal for forming the shaft part is formed into a cylindrical shape.
Figure 11B:
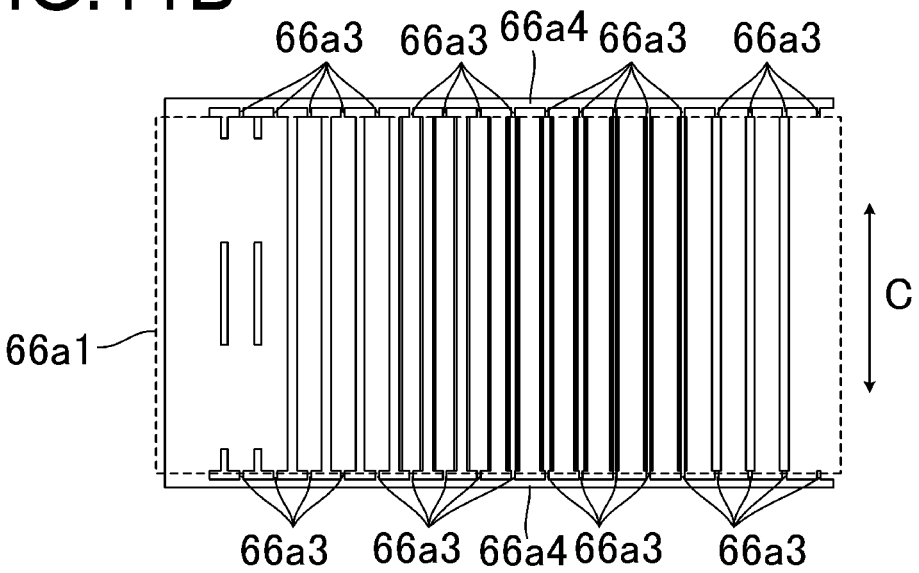
Figure 12:
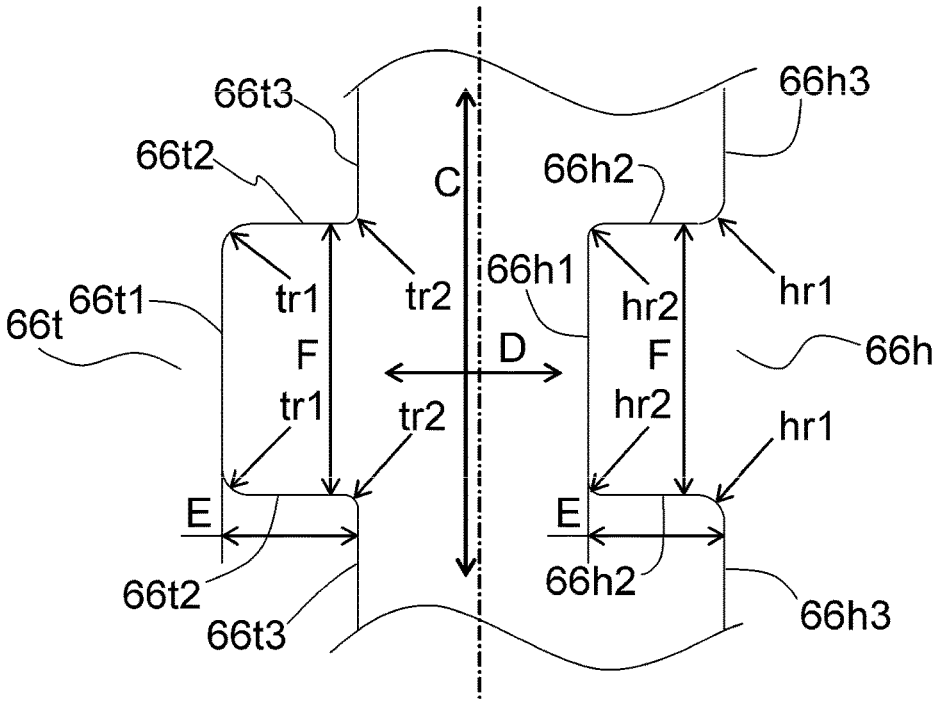
FIG. 12 is a partial enlarged view of the sheet metal for forming the shaft part according to the embodiment.
Figure 13:
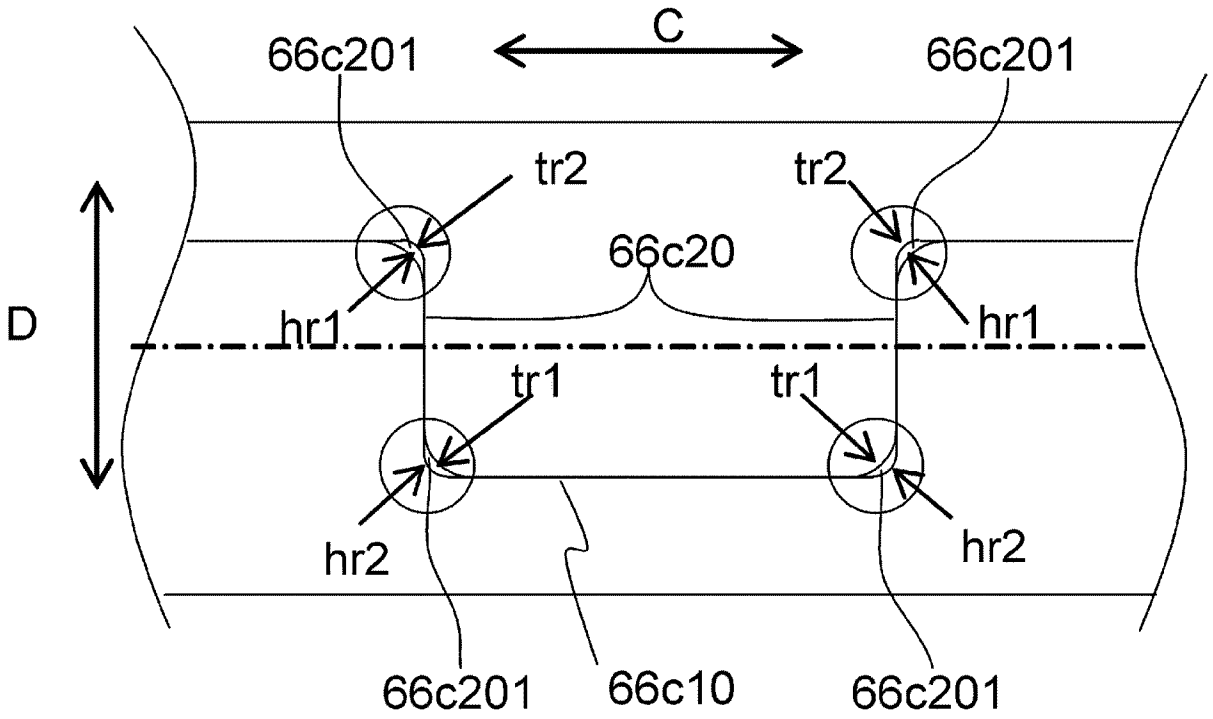
FIG. 13 is a diagram showing the shaft part of the charging roller according to the embodiment.
Figure 14A:
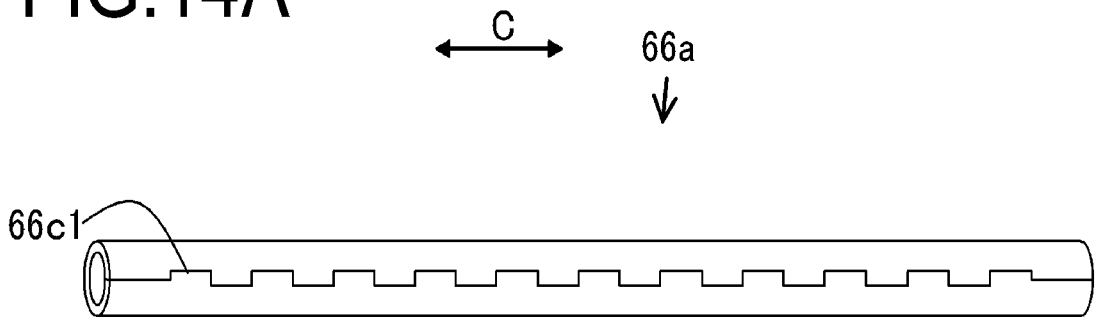
FIGS. 14A to 14C are diagrams showing a variation example of the charging roller according to the embodiment.
Figure 14B:
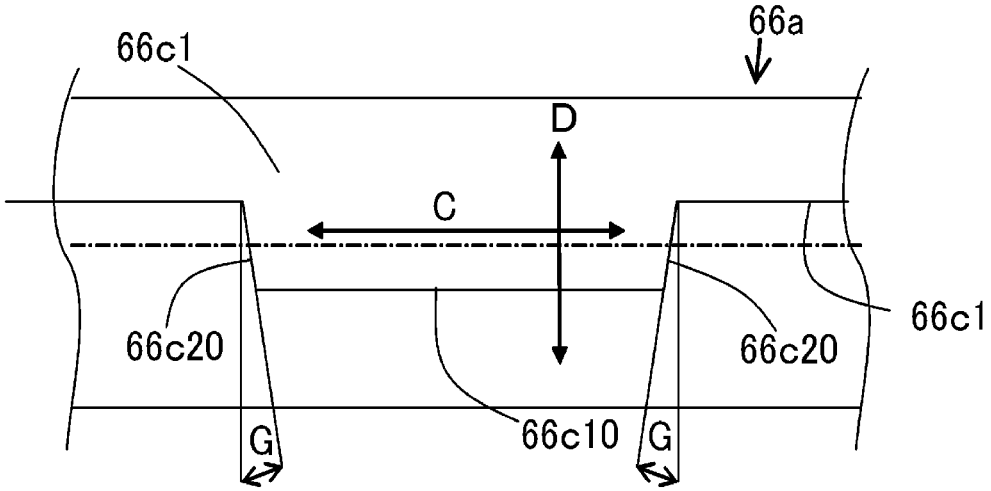
Figure 14C:
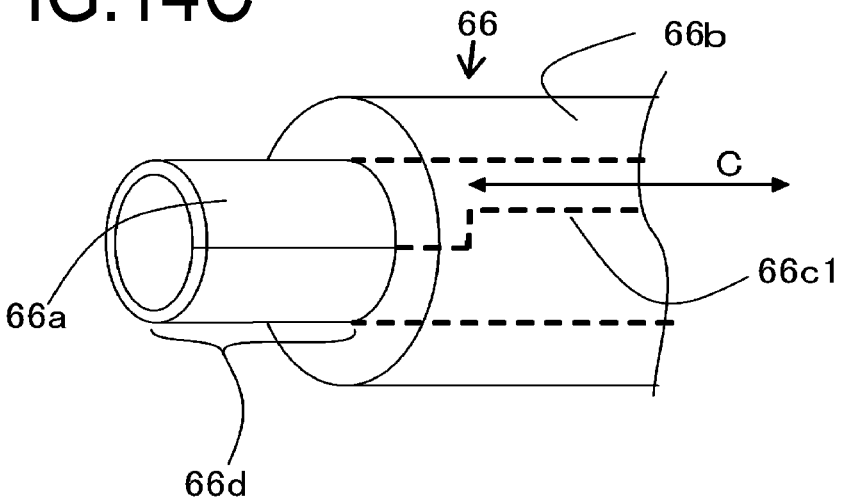

Next, the structure of the charging roller 66 will be described with reference to FIG. 1, and FIG. 8 to FIGS. 14A to 14C. FIG. 1 is a perspective view of the charging roller 66 and charging roller bearing 67L. FIGS. 9A and 9B are diagrams showing the structure of the shaft part 66*a* of the charging roller 66 according to the embodiment. FIG. 10 is a diagram showing a sheet metal used to form the shaft part 66*a* according to the embodiment. FIGS. 11A and 11B are diagrams showing how the sheet metal for forming the shaft part 66*a* is formed into a cylindrical shape. FIG. 12 is a diagram of the sheet metal for forming the shaft part 66*a* according to the embodiment, which shows an enlarged view of part DT2 in FIG. 10. FIG. 13 is a diagram showing the shaft part 66*a* of the charging roller 66 according to the embodiment, which shows an enlarged view of part DT1 in FIG. 9A. FIGS. 14A to 14C are diagrams showing a variation example of the charging roller 66 according to the embodiment. FIG. 9A is a diagram for explaining the structure of the shaft part 66*a*. FIG. 9B is a diagram showing the structure of an end portion 66*d* of the shaft part 66*a* of the charging roller 66.

As shown in FIG. 1, the charging roller 66 is made up of the shaft part 66*a* and the elastic layer 66*b* that covers the shaft part 66*a*. As shown in FIG. 8, the shaft part 66*a* of the charging roller 66 is made by forming a flat sheet 66*a*1 of conductive metal into a cylindrical shape by pressing.

The shaft part 66*a* of the charging roller 66 is formed by bending a flat sheet of metal (66*a*1) into a cylindrical shape, so that the shaft part 66*a* has a joint part (joint portion) 66*c* along the axial direction C thereof (see FIGS. 9A and 9B) where end portions of the sheet metal face and contact each other. Namely, in this embodiment, the outer circumferential surface of the shaft part 66*a* is circumferentially interrupted, from one end to the other end in the axial direction of the shaft part 66*a*. In this embodiment, the shaft part 66*a* has an outer diameter of 6 mm, and an overall length of 252.5 mm in the axial direction C of the shaft part 66*a*.

As mentioned above, a tubular metal shaft generally has lower torsional strength as compared to a solid cylindrical metal shaft of the same diameter. In this embodiment, therefore, in order to ensure sufficient strength of the shaft part 66*a* of the charging roller 66, a plurality of projections and recesses 66*c*1 are provided at the joint part 66*c*. The joint part 66*c* and projections and recesses 66*c*1 will be described in more detail later.

Next, progressive press working, which is a common pressing process, for producing the shaft part 66*a* will be described as one example. As shown in FIG. 10, for the production of the shaft part 66*a*, sheet metal such as cold rolled steel sheet, zinc-plated steel sheet, and stainless steel sheet of about 0.6 mm thickness is used. The sheet metal has a larger width than the entire length in the axial direction C. This sheet metal is subjected to pressing (punching) to form strips of flat sheets 66*a*1 (portion to form a tube) extending in a direction intersecting the transport direction H, cross-pieces 66*a*4 that are continuous in the transport direction H, and connecting portions 66a3 connecting the strips of flat sheets 66a1 and the crosspieces 66a4.

Positioning holes 66a2 are provided in the crosspieces 66a4 for positioning the flat sheets 66a1 when the flat sheets 66a1 are conveyed from one step to another. The positioning holes 66a2 are located on the outer sides of the pair of connecting portions 66a3 in the direction orthogonal to the transport direction H, on the centerlines of the strips of flat sheets 66a1. As shown in FIG. 8, and FIGS. 11A and 11B, the crosspieces 66a4 are used to intermittently convey the sheet metal for repeated pressing, so that the portion to be formed into a tube (flat sheet 66a1) is progressively formed into a cylindrical shape in each step. Once the forming process of a flat sheet 66a1 is complete, the connecting portions 66a3 are cut, so that the portion formed into a tube (strip of flat sheet 66a1) is cut off from the crosspieces 66a4. The shaft part 66a of the charging roller 66 is thus formed.

The shape of the joint part 66c of the sheet metal in this embodiment will now be described in detail. As shown in FIG. 10, the strip of flat sheet 66a1 is substantially rectangular. The short sides 66a5 of the shaft part 66a of the charging roller 66 are parallel to the transport direction H, while the long side 66y1 and long side 66y2 that will form the joint part 66c are orthogonal to the transport direction H (parallel to the axial direction C). The long sides 66y1 and 66y2 are toothed, and projections and recesses are alternately arranged. In this embodiment, the projections and recesses are continuously formed from one end to the other end in the axial direction of the shaft part 66a. The projections and recesses have a rectangular shape in this embodiment. FIG. 12 is a diagram showing a toothed portion of the flat sheet 66a1 to a larger scale (enlarged view of part DT2 of FIG. 10). In this embodiment, this flat sheet 66a1 is bent into a tube, and recesses 66h and projections 66t are fitted together so as to form the joint portion 66c10 (see FIGS. 9A and 9B, and FIG. 13).

Next, the shape of the toothed portion of the flat sheet 66a1 will be described in more detail with reference to FIG. 12 and FIG. 13. The recess 66h on one of the cut faces of the flat sheet 66a1 has an opposite circumferential face 66h1 and opposite circumferential faces 66h3, which are faces orthogonal to the circumferential direction of the shaft part 66a. The recess 66h has opposite side faces 66h2, which are faces orthogonal to the axial direction of the shaft part 66a. The shaft part 66a has corner portions hr2 (corresponding to second corner portion) formed in portions where the opposite circumferential face 66h1 and the opposite side faces 66h2 are connected, and corner portions hr1 formed in portions where the opposite circumferential faces 66h3 and the opposite side faces 66h2 are connected.

The projection 66t on the other one of the cut faces of the flat sheet 66a1 has an opposite circumferential face 66t1 and opposite circumferential faces 66t3, which are faces orthogonal to the circumferential direction of the shaft part 66a. The projection 66t has opposite side faces 66t2, which are faces orthogonal to the axial direction of the shaft part 66a. The projection 66t has corner portions tr1 (corresponding to first corner portion) formed in portions where the opposite circumferential face 66t1 and the opposite side faces 66t2 are connected, and corner portions tr2 formed in portions where the opposite circumferential faces 66t3 and the opposite side faces 66t2 are connected. In this embodiment, dimension E, which is the length of the opposite side faces 66h2 and opposite side faces 66t2, is 2 mm. Dimension F, which is the length of the opposite circumferential face 66h1 and opposite circumferential face 66t1, is 10.5 mm.

As shown in FIG. 13, when the flat sheet 66a1 is formed into a tube, the opposite circumferential face 66t1 and opposite circumferential face 66h1 together forma first joint portion 66c10, and the opposite side faces 66t2 and opposite side faces 66h2 together form second joint portions 66c20. The sheet metal is in tight contact with each other in each of the joints (first joint portion 66c10 and second joint portions 66c20). In this embodiment, as the flat sheet 66a1 makes tight contact with each other in the circumferential direction and axial direction of the shaft part 66a in this way, the torsional rigidity of the shaft part 66a is enhanced.

In this embodiment, the corner portions hr2, corner portions tr2, corner portions hr1, and corner portions tr1 are rounded in an arc. The relationship between the radii of curvature of the arcuate rounded corner portions and the torsional rigidity was investigated through tests. The test results are shown in Table 1.

TABLE 1

| Pattern | Radius of tr1, hr1 (mm) | Radius of tr2, hr2 (mm) | Torsional rigidity (Nm/deg) |
|---|---|---|---|
| 1 | R0.3 | R0.3 | 0.21 |
| 2 | R0.5 | R0.3 | 0.34 |

As shown in Table 1, by making the radius of curvature of the corner portions hr1 and tr1 larger than the radius of curvature of the corner portions hr2 and tr2, gaps 66c201 are formed each between the corner portion hr1 and the corner portion tr2, and between the corner portion tr1 and the corner portion hr2. It was found out that the torsional rigidity thereby becomes about 1.6 times higher. When, as in Pattern 1, the radius of curvature of the corner portions hr1 and tr1 is the same as the radius of curvature of the corner portions hr2 and tr2, the corner portions tr1 and hr2 interfere with each other, and so do the corner portions hr1 and tr2, due to dimensional variations inevitable in manufacturing. This deteriorates the tight contact between the projections 66t and recesses 66h at the joint portion 66c10 and the joint portions 66c20 in the circumferential direction and axial direction of the shaft part 66a. On the other hand, when, as in Pattern 2, the radius of curvature of the corner portions hr1 and tr1 is larger than the radius of curvature of the corner portions hr2 and tr2, gaps 66c201 are formed, and interference between the corner portions tr1 and hr2 (corner portions hr1 and tr2) can be minimized. That is, the tight contact between the projections 66t and recesses 66h is not adversely affected in the axial direction C and circumferential direction D of the shaft part 66a, as a result of which the torsional rigidity of the shaft part 66a is enhanced.

As described above, in this embodiment, the metal shaft part 66a, which is made by forming the flat sheet 66a1 into a tube, has a toothed joint part (shape with projections and recesses). The corner portions of the projections and recesses of the shaft part 66a are rounded in an arc. The radius of curvature of the arcuate rounded portions of the projections is set somewhat larger than the radius of curvature of the arcuate rounded portions of the recesses. Consequently, gaps 66c201 are formed each between the corner portions hr1 and tr2, and between the corner portions tr1 and hr2, so that torsional rigidity of the shaft part 66a is secured, and the shaft part 66a can obtain necessary strength as the shaft part 66a of the charging roller 66. The second joint portions 66c20 are formed on both sides of the first joint portion 66c10 in the axial direction of the shaft part 66a. The first joint portion 66c10 and two joint portions 66c20 are connected via the first corner portions tr1 provided to the projections 66*t* and second corner portions hr2 provided to the recesses 66*h*. On one end of the two second joint portions 66*c*20 are each formed the corner portions hr1, where the opposite side faces 66*h*2 and the opposite circumferential faces 66*h*3 are connected, and the corner portions tr2, where the opposite side faces 66*t*2 and the opposite circumferential faces 66*t*3 are connected. Namely, the corner portions hr1, which correspond to the first corner portion, and the corner portions tr2, which correspond to the second corner portion, are formed on one end of the two second joint portions 66*c*20 opposite from the side where they connect to the first joint portion 66*c*10.

Another example of providing gaps between opposite corner portions, wherein the corner portions have a shape that can avoid interference with the opposite corner portions, will be described below.

(Example where Corner Portions are Beveled)

Figure 15A:
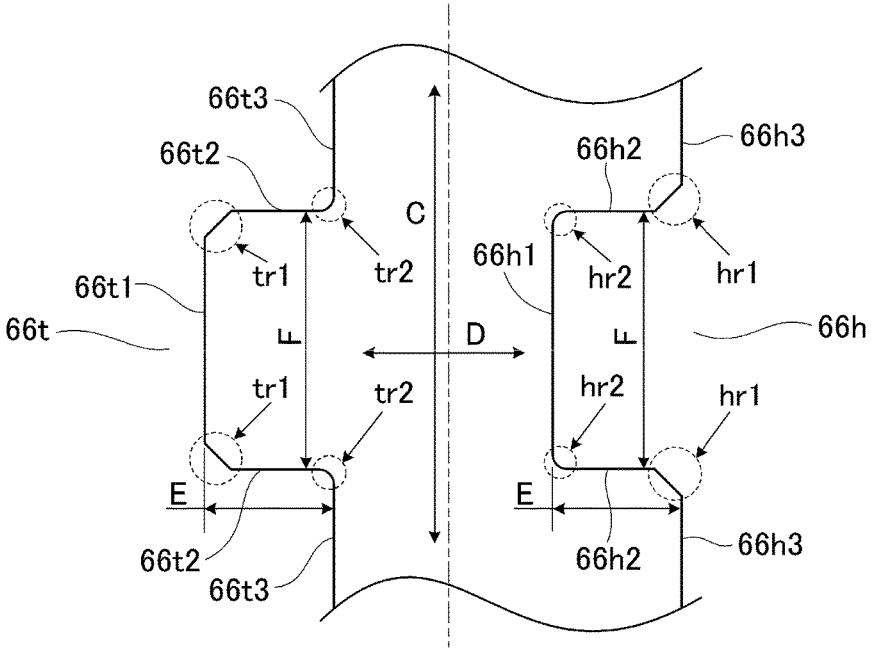
FIGS. 15A and 15B are partial enlarged views of the sheet metal for forming the shaft part according to the embodiment.
Figure 15B:
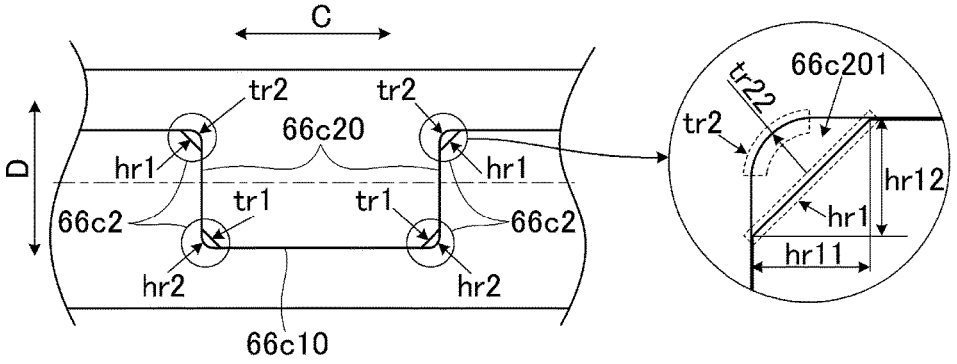

FIGS. 15A and 15B show an example where the corner portions hr1 and tr1 are beveled (C-shaped).

FIG. 15A is a partial enlarged view of a flat sheet 66*a*1 for forming a shaft part, and FIG. 15B is a partial enlarged view of the flat sheet 66*a*1 formed into a tube. The corner portions hr2 and tr2 are rounded in an arc. The corner portions hr1 and tr1 are beveled. Here, by providing the corner portions hr1 and tr1 with a larger beveled edge (lengths hr11 and hr12) than the radius of curvature tr22 of the corner portions hr2 and tr2, gaps 66*c*201 can be formed between the corner portions hr1 and tr1 and the corner portions hr2 and tr2.

(Example where Corner Portions are Notched)

FIGS. 16A and 16B, and FIGS. 17A and 17B each show an example where the corner portions hr1 and tr1 are notched (recessed).

Figure 16A:
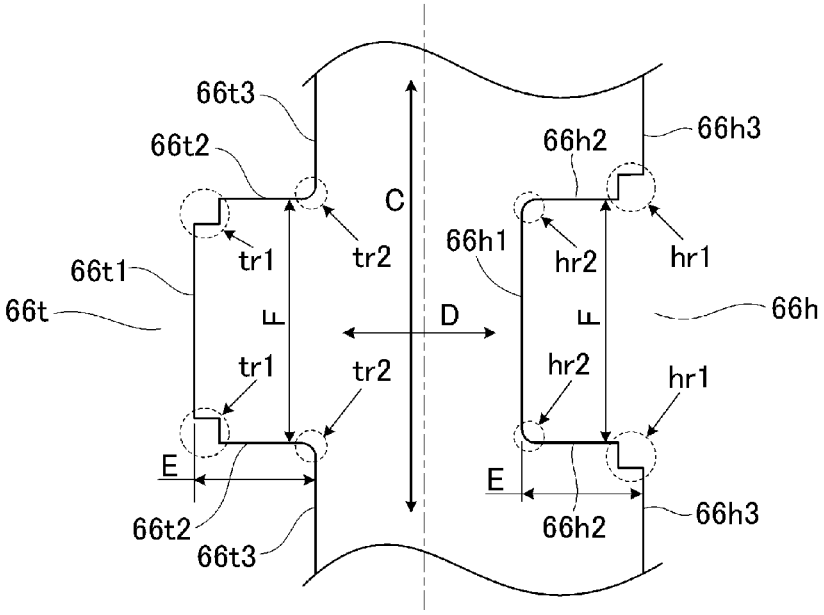
FIGS. 16A and 16B are partial enlarged views of the sheet metal for forming the shaft part according to the embodiment.
Figure 16B:
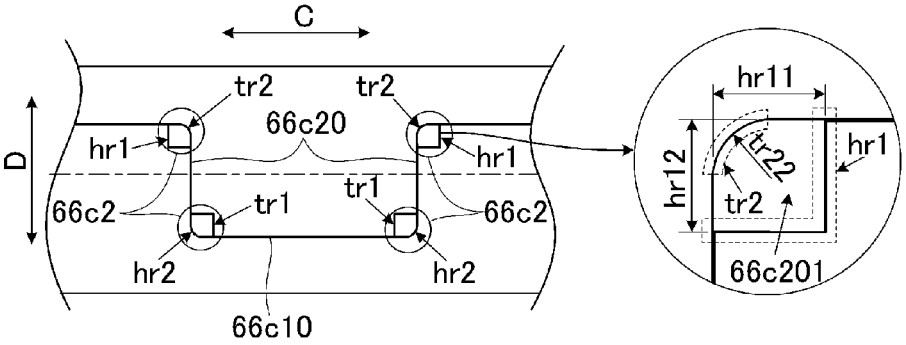
Figure 17A:
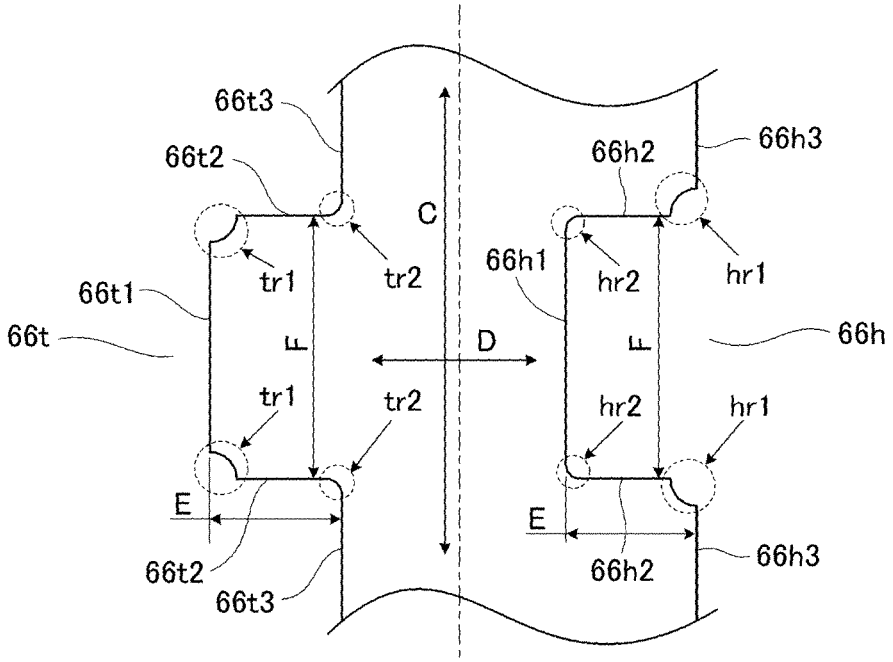
FIGS. 17A and 17B are partial enlarged views of the sheet metal for forming the shaft part according to the embodiment.
Figure 17B:
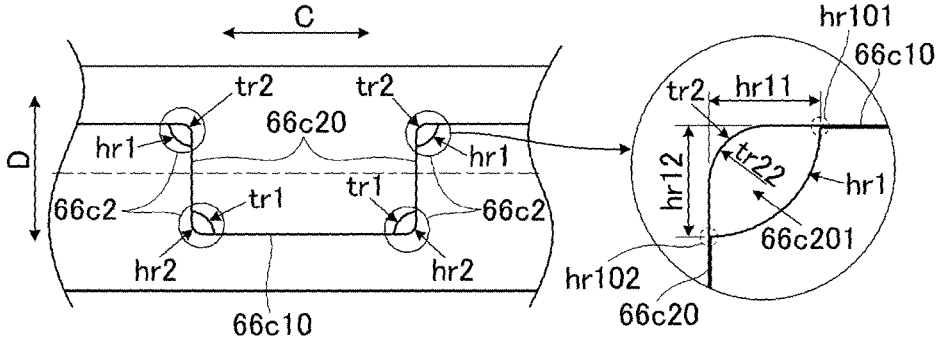

FIG. 16A and FIG. 17A are partial enlarged views of a flat sheet 66*a*1 for forming a shaft part, and FIG. 16B and FIG. 17B are partial enlarged views of the flat sheet 66*a*1 formed into a tube.

As shown in FIGS. 16A and 16B, the corner portions hr1 and tr1 are notched away from the corner portions hr2 and tr2, whereas the corner portions hr2 and tr2 are rounded in an arc. Here, by notching the corner portions hr1 and tr1 with the distances hr11 and hr12 in the axial direction C and circumferential direction D that are larger than the radius of curvature tr22 of the corner portions hr2 and tr2, gaps 66*c*201 can be formed between the corner portions hr1 and tr1 and the corner portions hr2 and tr2.

The notch may be curved in an arc as shown in FIGS. 17A and 17B. The radius of curvature of the corner portions hr2 and tr2 is denoted by tr22. The point of distance hr11 that is larger than the radius of curvature tr22 in the axial direction C away from the corner portions hr2 and tr2 is denoted by hr10*l*. The point of distance hr12 that is larger than the radius of curvature tr22 in the circumferential direction D away from the corner portions hr2 and tr2 is denoted by hr102. Gaps 66*c*201 can be provided by forming a circular arc curve that passes through point hr10*l* and point hr102, bent away from the corner portions hr2 and tr2. The notch may be dented away from the corner portions hr2 and tr2 in a polygonal shape that passes through point hr101 and point hr102. Any desirable notch shape can be selected (not shown).

Next, a configuration that prevents interference between corner portions will be described below.

(Examples where Corner Portions have a Circular Arc Recess)

FIGS. 18A and 18B, FIGS. 19A and 19B, FIGS. 20A and 20B, and FIGS. 21A and 21B show examples where corner portions are provided with a circular arc recess.

FIG. 18A, FIG. 19A, FIG. 20A, and FIG. 21A are partial enlarged views of a flat sheet 66*a*1 for forming a shaft part, and FIG. 18B, FIG. 19B, FIG. 20B, and FIG. 21B are partial enlarged views of the flat sheet 66*a*1 formed into a tube.

FIGS. 18A and 18B, and FIGS. 21A and 21B each show an example where a circular arc interference-preventing shape is provided in the corner portions in the axial direction C. FIGS. 19A and 19B show an example where a circular arc interference-preventing shape is provided in the corner portions in the circumferential direction D. FIGS. 20A and 20B show an example where a circular arc interference-preventing shape is provided in the corner portions in the axial direction C and circumferential direction D.

Figure 18A:
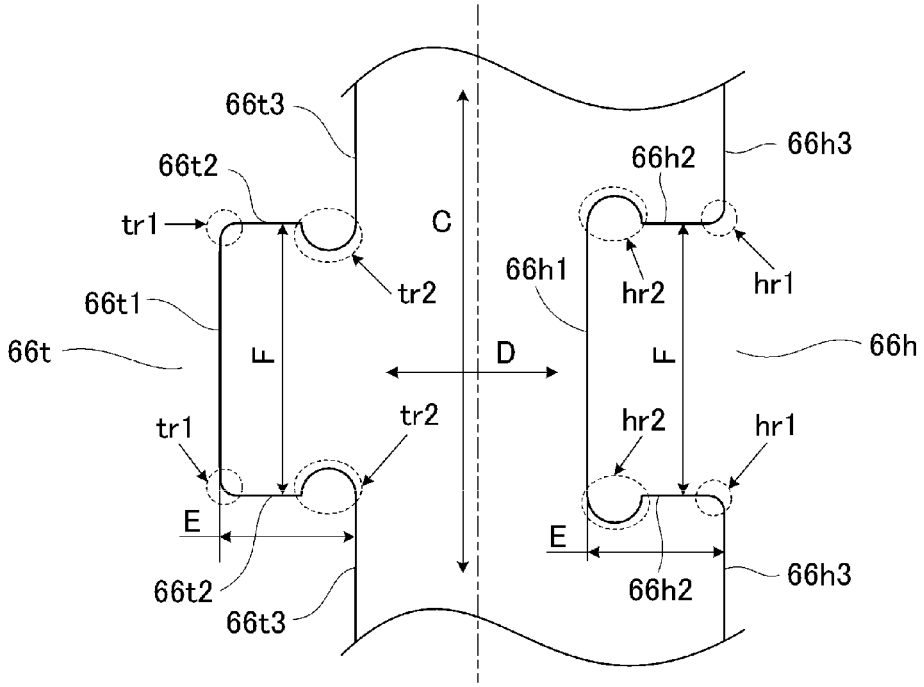
FIGS. 18A and 18B are partial enlarged views of the sheet metal for forming the shaft part according to the embodiment.
Figure 18B:
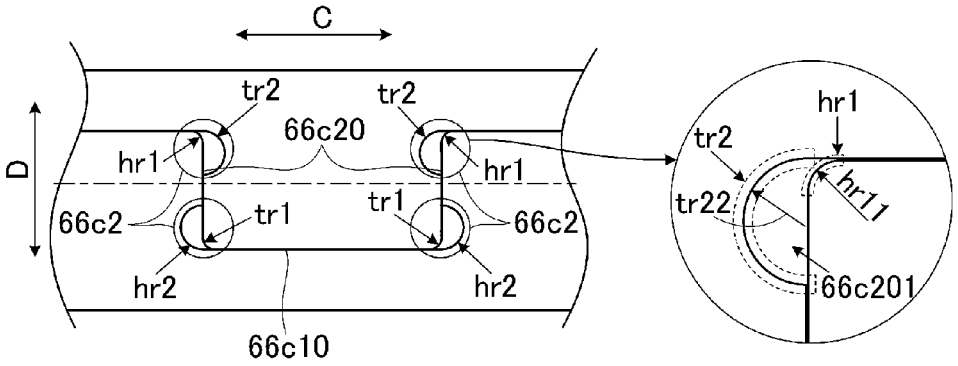
Figure 19A:
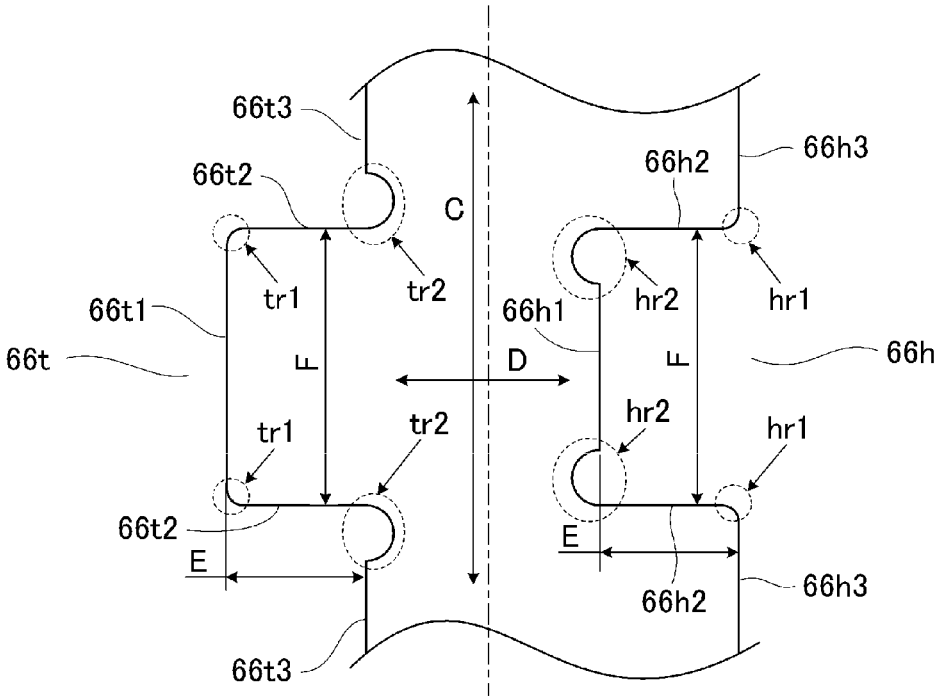
FIGS. 19A and 19B are partial enlarged views of the sheet metal for forming the shaft part according to the embodiment.
Figure 19B:
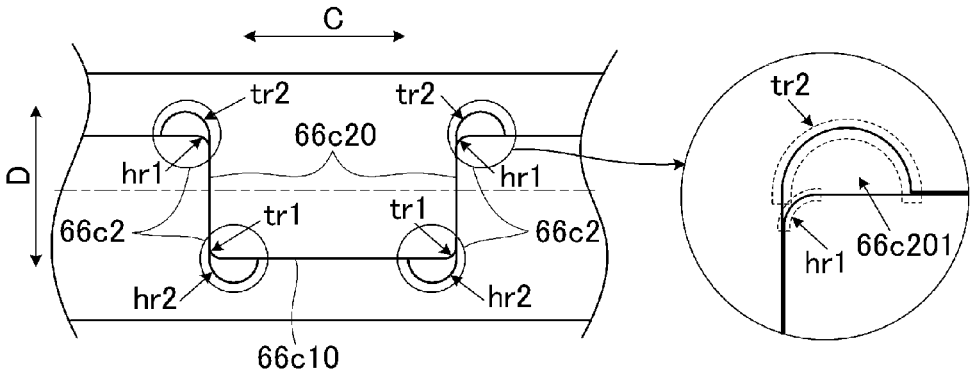
Figure 20A:
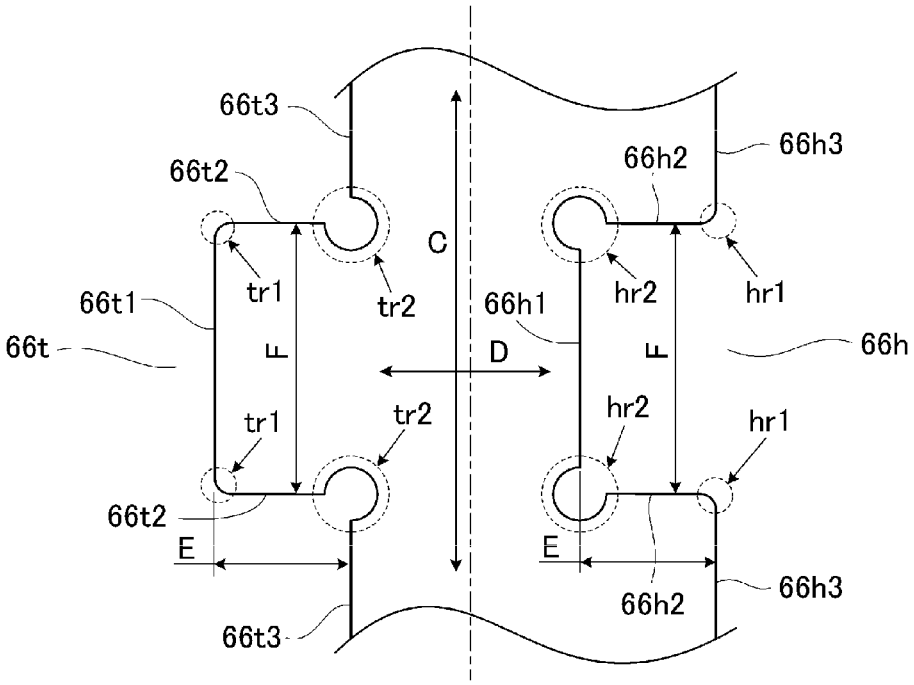
FIGS. 20A and 20B are partial enlarged views of the sheet metal for forming the shaft part according to the embodiment.
Figure 20B:
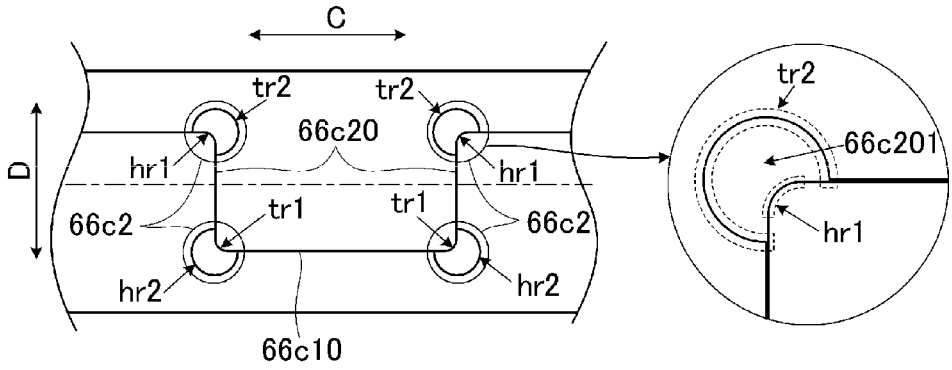
Figure 21A:
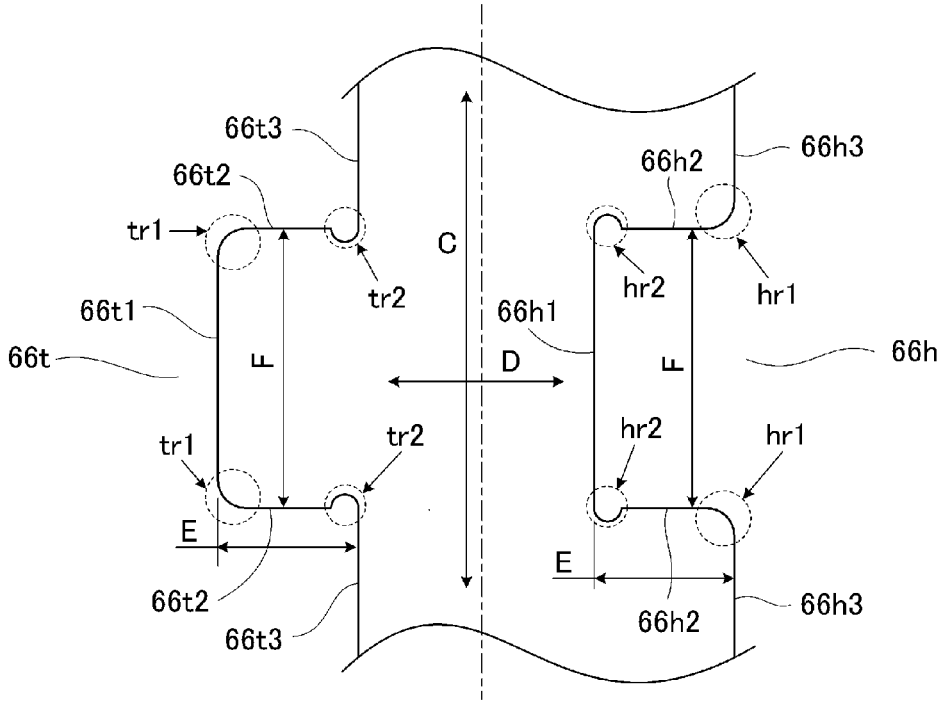
FIGS. 21A and 21B are partial enlarged views of the sheet metal for forming the shaft part according to the embodiment.
Figure 21B:
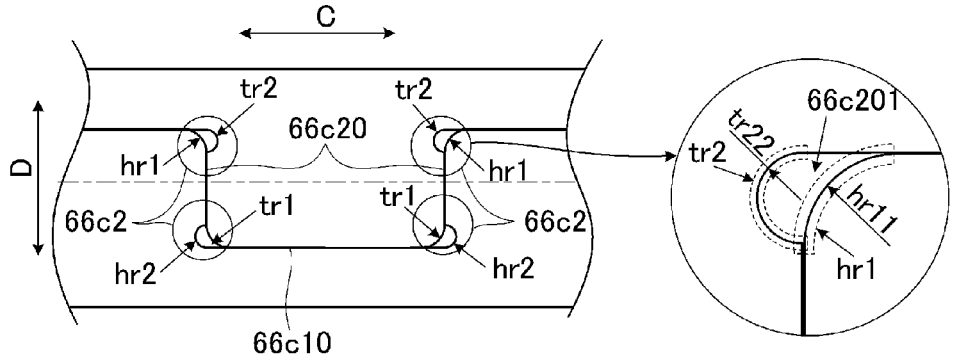

As shown in FIGS. 18A and 18B, FIGS. 19A and 19B, and FIGS. 20A and 20B, a circular arc interference-preventing shape is provided in the corner portions hr2 and tr2 in either one or both of the axial direction C and circumferential direction D. Gaps 66*c*201 can be formed by providing such a circular arc interference-preventing shape in the corner portions hr2 and tr2. In this case, gaps 66*c*201 can be formed either in a case where the radius of curvature hr11 of the corner portions hr1 and tr1 is larger than tr22, or a case where the radius of curvature tr22 of the corner portions hr2 and tr2 is larger than hr11. For example, FIGS. 18A and 18B show an example where the radius of curvature tr22 of the corner portions hr2 and tr2 is larger than the radius of curvature hr11 of the corner portions hr1 and tr1. FIGS. 21A and 21B show an example where the radius of curvature hr11 of the corner portions hr1 and tr1 is larger than the radius of curvature tr22 of the corner portions hr2 and tr2.

(Examples where Corner Portions have a Polygonal Recess)

FIGS. 22A and 22B, FIGS. 23A and 23B, and FIGS. 24A and 24B show examples where corner portions have a polygonal recess.

Figure 22A:
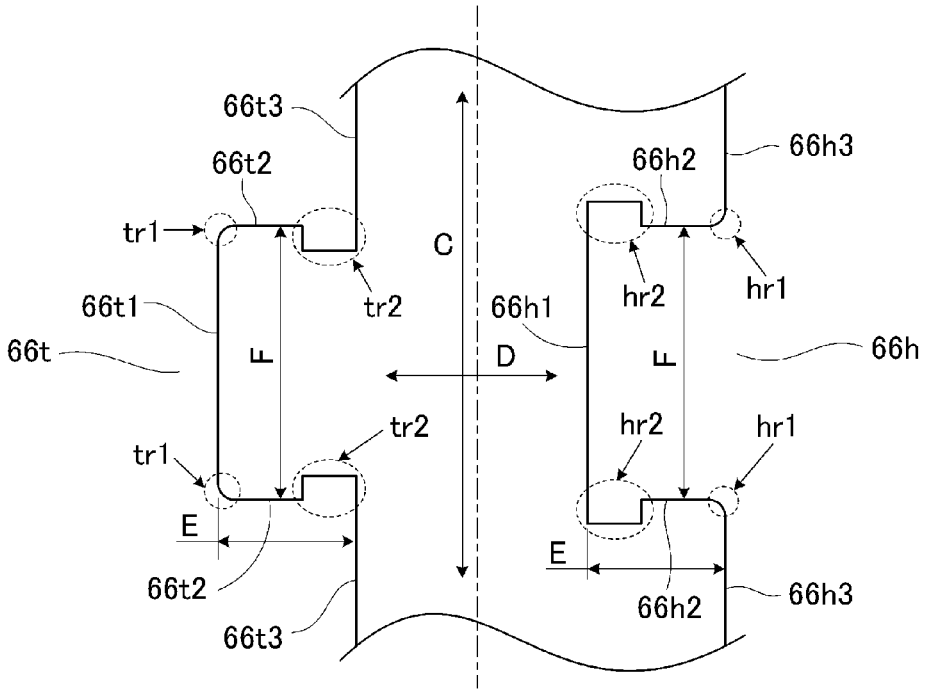
FIGS. 22A and 22B are partial enlarged views of the sheet metal for forming the shaft part according to the embodiment.
Figure 22B:
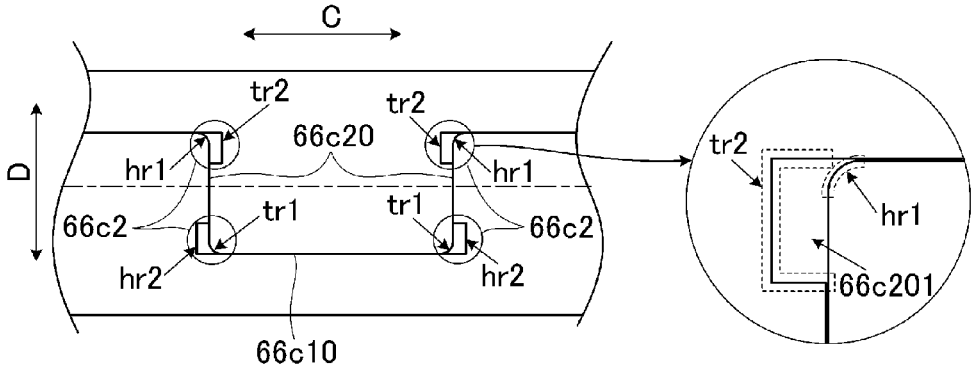
Figure 23A:
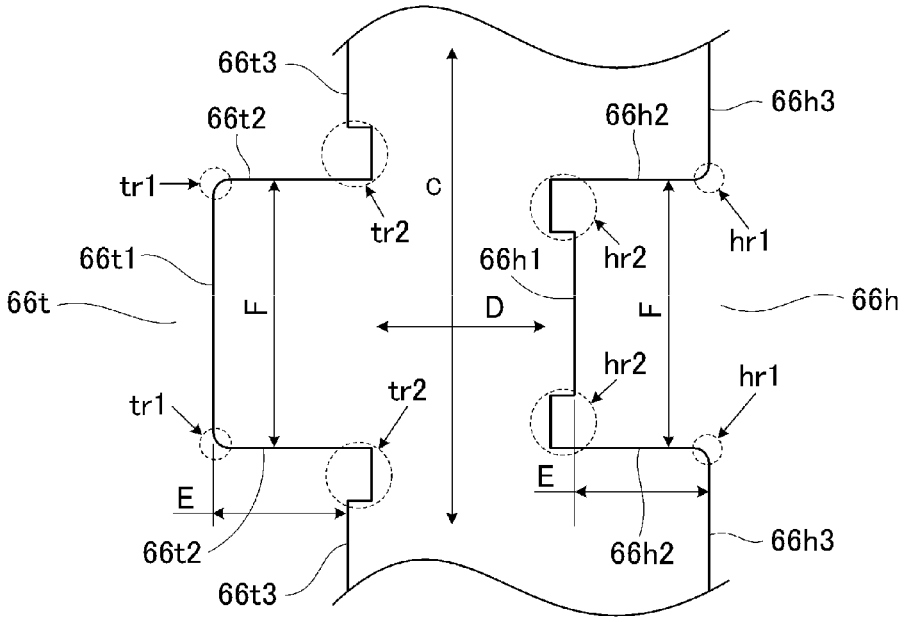
FIGS. 23A and 23B are partial enlarged views of the sheet metal for forming the shaft part according to the embodiment.
Figure 23B:
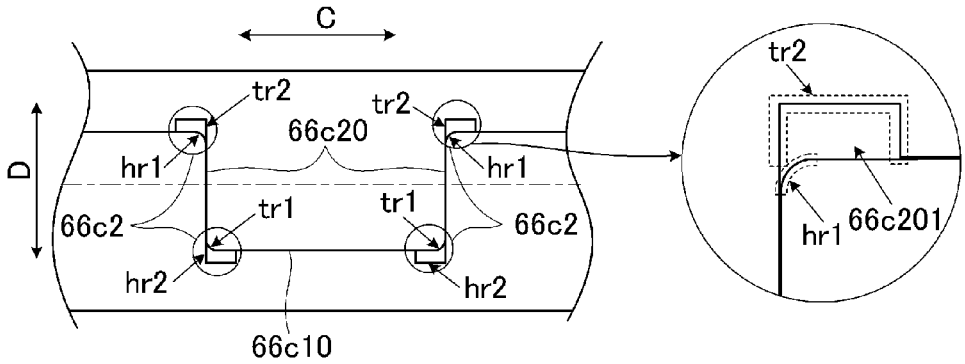
Figure 24A:
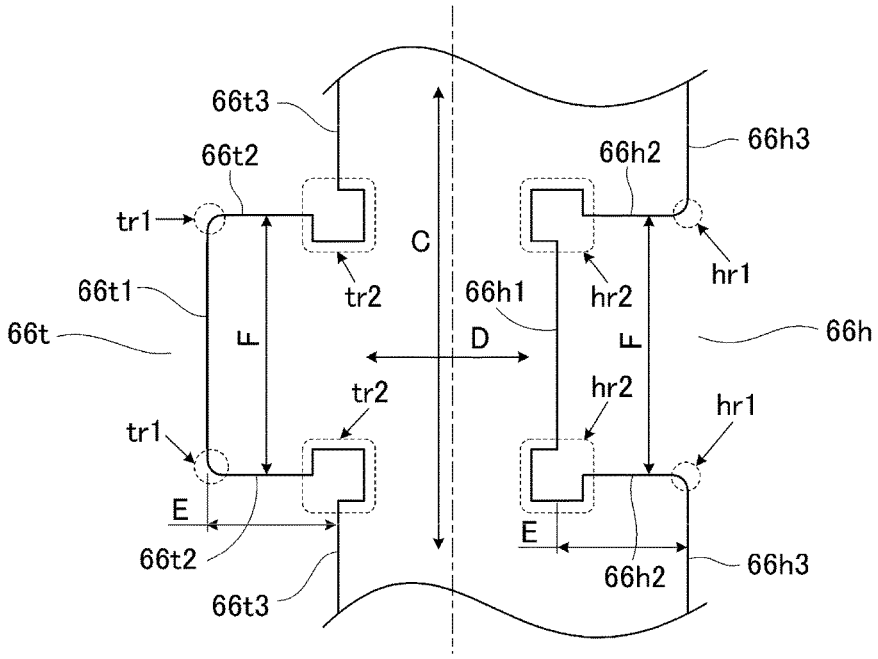
FIGS. 24A and 24B are partial enlarged views of the sheet metal for forming the shaft part according to the embodiment.
Figure 24B:
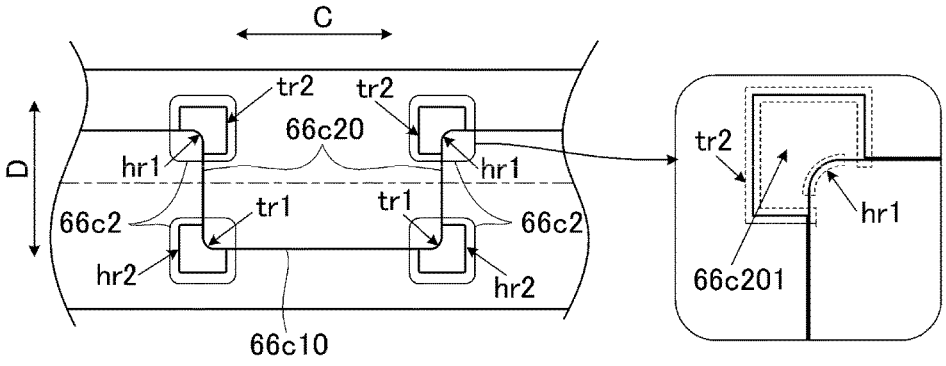

FIG. 22A, FIG. 23A, and FIG. 24A are partial enlarged views of a flat sheet 66*a*1 for forming a shaft part, and FIG. 22B, FIG. 23B, and FIG. 24B are partial enlarged views of the flat sheet 66*a*1 formed into a tube.

FIGS. 22A and 22B show an example where a polygonal recess as an interference-preventing shape is provided in the corner portions in the axial direction C.

FIGS. 23A and 23B show an example where a polygonal recess as an interference-preventing shape is provided in the corner portions in the circumferential direction D.

FIGS. 24A and 24B show an example where a polygonal recess as an interference-preventing shape is provided in the corner portions in the axial direction C and circumferential direction D.

As shown in FIGS. 22A and 22B, FIGS. 23A and 23B, and FIGS. 24A and 24B, an interference-preventing shape is provided in the form of a polygonal recess in the corner portions hr2 and tr2. Gaps 66*c*201 can be formed between the corner portions hr2 and tr2 and the corner portions hr1 and tr1 by providing an interference-preventing shape in the corner portions hr2 and tr2 in either one or both of the axial direction C and circumferential direction D.

Gaps 66*c*201 can be formed (not shown) in the corner portions hr2 and tr2 irrespective of the size of the interference-preventing shape by providing an interference-preventing shape in the corner portions hr2 and tr2 at least in one of the axial direction C and circumferential direction D.

The interference-preventing configurations for the corner portions described above can be combined.

Figure 25A:
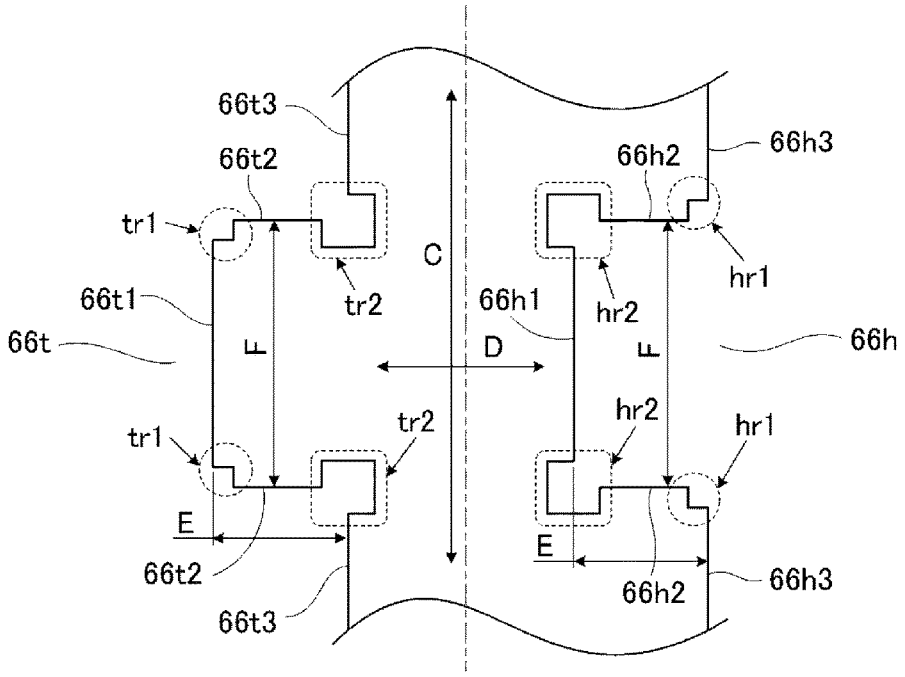
FIGS. 25A and 25B are partial enlarged views of the sheet metal for forming the shaft part according to the embodiment.
Figure 25B:
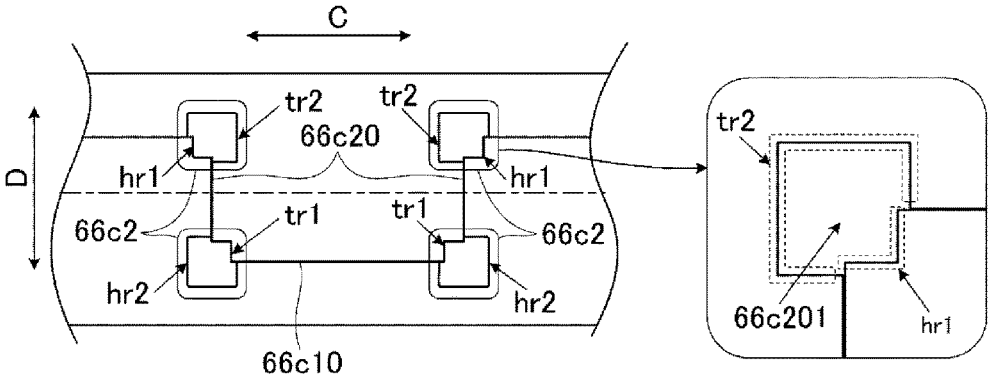

FIGS. 25A and 25B show an example where a recess is provided to both of the opposite corner portions.

FIGS. 25A and 25B are partial enlarged views of a flat sheet 66*a*1 for forming a shaft part, and FIG. 25B is a partial enlarged view of the flat sheet 66*a*1 formed into a tube.

For example, as shown in FIGS. 25A and 25B, the corner portions hr1 and tr1 may be notched, while the corner portions hr2 and tr2 may have an interference-preventing configuration in the form of a polygonal recess, so as to form gaps 66*c*201 at the joint portion 66*c*20. The configuration is not limited to this one where an interference-preventing configuration is provided in the corner portions hr1 and tr1 in the form of a square notch, as well as an interference-preventing configuration is provided in the corner portions hr2 and tr2 in the form of a polygonal recess. Various interference-preventing configurations for corner portions can be applied to each of the corner portions hr2 and tr2 and corner portions hr1 and tr1 to form gaps 66*c*201.

As a variation example of this embodiment, as shown in FIG. 14A, the number of projections and recesses formed to the first joint portion 66*c*10 and second joint portions 66*c*20 may be increased as required. This increases the area of the region where the projections 66*t* and recesses 66*h* make tight contact, so that the frictional force between the projections 66*t* and recesses 66*h* is increased to further enhance the torsional rigidity of the shaft part 66*a*. Optionally, as shown in FIG. 14B, the opposite side faces 66*t*2 and opposite side faces 66*h*2 in this embodiment may be inclined at an angle G relative to the circumferential direction D of the shaft part 66*a*, so that the projections 66*t* and recesses 66*h* can make tight contact with each other more easily. More specifically, in FIG. 14B, the projection 66*t* has a trapezoidal shape with two corner portions, and the projection 66*t* is tapered in width toward the direction in which it protrudes. The recess 66*h* has two corner portions, and has a trapezoidal shape for the projection 66*t* to fit in. In this case, the second joint portions 66*c*20 intersect with the first joint portion 66*c*10, which is formed along the axial direction of the shaft part 66*a*, diagonally relative to the axial direction. In this case, too, as described above, the radius of curvature of the corner portions hr1 and tr1 is made larger than the radius of curvature of the corner portions hr2 and tr2. This way, the shaft part 66*a* can be made at lower cost, and can have even higher rigidity.

While the charging roller 66 is integrated in the cartridge B in this embodiment, it need not necessarily be so. For example, the charging roller 66 may be integrated into a main body of an image forming apparatus that does not employ a cartridge system. The charging roller 66 only may be removably attached to the cartridge B or the main body of the image forming apparatus S.

In this embodiment, the shaft part 66*a* need not necessarily be the rotating shaft of the charging roller 66. For example, the shaft part 66*a* may be the rotating shaft of the developing roller 32, transfer roller 7, and the like. The structure of the shaft part 66*a* such as the outer diameter, overall length, number of projections and recesses can be changed as suited in accordance with the required function.

As described above, in this embodiment, the projections and recesses are formed at the joint part in the shaft part 66*a*, where the projections 66*t* on one side fit in the recesses 66*h* of the other side, and the projections 66*t* on the other side fit in the recesses 66*h* of the one side. The projections 66*t* have corner portions tr1 rounded in an arc, while the recesses 66*h* have corner portions hr2 rounded in an arc for the corner portions tr1 to fit in. In this embodiment, the radius of curvature of the corner portions tr1 is larger than the radius of curvature of the corner portions hr2. Gaps 66*c*201 are formed this way to minimize the reduction in strength of the cylindrical shaft part 66*a* with joint parts.

In this embodiment, the projections 66*t* and recesses 66*h* are continuously formed from one end to the other end in the axial direction of the shaft part 66*a*. This way, a large number of projections 66*t* and recesses 66*h* are provided, so that the strength of the shaft part 66*a* can be enhanced even more.

In this embodiment, the projections 66*t* have a trapezoidal shape with two corner portions tr1, and the projections 66*t* are tapered in width toward the direction in which they protrude. The recesses 66*h* have a trapezoidal shape with two corner portions hr2, for the projections 66*t* to fit in. This way, a tight contact can be made easily at the joint part in the shaft part 66*a*, so that the strength of the shaft part 66*a* can be enhanced even more. This also allows the recesses 66*h* and projections 66*t* to fit together more easily during production to avoid complications in production processes, as a result of which the shaft part 66*a* can be fabricated at lower cost.

The second joint portions 66*c*20 are not necessarily formed along the circumferential direction or a direction orthogonally intersecting the axial direction of the shaft part 66*a* as shown in FIG. 13, relative to the first joint portion formed along the axial direction of the shaft part 66*a*. The second joint portions may be formed along a direction diagonally intersecting the axial direction of the shaft part 66*a* relative to the first joint portion as shown in FIGS. 14A to 14C. Namely, the second joint portions are formed in a direction intersecting the axial direction of the shaft part 66*a*, and may intersect the first joint portion that is formed along the axial direction of the shaft part 66*a* orthogonally, or diagonally.

In this embodiment, the shapes of the projections 66*t* and recesses 66*h* are not necessarily limited to rectangular or trapezoidal. For example, the projections 66*t* and recesses 66*h* may have a pentagonal or hexagonal shape. The shapes of the projections 66*t* and recesses 66*h* are not particularly limited as long as the strength of the shaft part 66*a* can be increased.

In this embodiment, the projections 66*t* and recesses 66*h* need not necessarily be formed continuously from one end to the other end in the axial direction of the shaft part 66*a*. For example, the projections 66*t* and recesses 66*h* may be formed in a portion of the shaft part 66*a* from one end to the other end in the axial direction of the shaft part 66*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2016-127928, filed on Jun. 28, 2016 and Japanese Patent Application No. 2017-106477, filed on May 30, 2017, which are hereby incorporated by reference herein in their entirety.

What is claimed is:

1. A rotating member used in an image forming apparatus or in a process cartridge mountable to a main body of the image forming apparatus, the rotating member comprising:

a cylindrical rotating shaft, the shaft including a first end portion in a circumferential direction thereof and a second end portion opposite to the first end portion in the circumferential direction, wherein the first end portion and the second end portion face each other and extend in a direction along a rotational axis of the shaft, wherein the first end portion has a projection which projects in a direction approaching the second end portion in the circumferential direction of the shaft and which includes convex round corners, and the second end portion has a recess which is recessed in a direction away from the first end portion in the circumferential direction of the shaft and which includes concave round corners, wherein the projection of the first end portion engages with the recess of the second end portion so that at least a part of an edge of the projection contacts with at least a part of an edge of the recess and so that each of the convex round corners of the projection faces each of the concave round corners of the recess with a gap therebetween, and wherein each of the convex round corners has a radius of curvature larger than that of each of the concave round corners so as to form the gap.

2. The rotating member according to claim 1, wherein the projection has a rectangular shape with the convex round corners, and the recess has a rectangular shape with the concave round corners.

3. The rotating member according to claim 1, wherein the projection has a trapezoidal shape with the convex round corners, tapered in width toward a direction in which the projection projects, and the recess has a trapezoidal shape with the concave round corners, with which the projection engages.

4. The rotating member according to claim 1, wherein the rotating shaft is made of metal.

5. The rotating member according to claim 1, wherein the rotating member is a charging roller that charges an image bearing member for forming an image on the recording medium.

6. A process cartridge mountable to a main body of an image forming apparatus and forming a developer image, the process cartridge comprising:

the rotating member according to claim 5;

an image bearing member on which a developer image is formed; and a developing apparatus that develops an electrostatic latent image formed on the image bearing member, wherein the image bearing member is configured to be charged by the rotating member, the charged image bearing member is configured to be exposed so that an electrostatic latent image is formed on the image bearing member, and the developing apparatus is configured to develop the electrostatic latent image formed on the image bearing member to form a developer image on the image bearing member.

7. An image forming apparatus forming an image on a recording medium, the image forming apparatus comprising:

the rotating member according to claim 5;

an image bearing member on which a developer image is formed; and a developing apparatus that develops an electrostatic latent image formed on the image bearing member, wherein the image bearing member is configured to be charged by the rotating member, the charged image bearing member is configured to be exposed so that an electrostatic latent image is formed on the image bearing member, the developing apparatus is configured to develop the electrostatic latent image formed on the image bearing member to form a developer image on the image bearing member, and the developer image formed on the image bearing member is configured to be transferred to a recording medium so that an image is formed on the recording medium.

8. A rotating member used in an image forming apparatus or in a process cartridge mountable to a main body of the image forming apparatus, the rotating member comprising:

a cylindrical rotating shaft, the shaft including a first end portion in a circumferential direction thereof and a second end portion opposite to the first end portion in the circumferential direction, wherein the first end portion and the second end portion face each other and extend in a direction along a rotational axis of the shaft, wherein the first end portion has a projection which projects in a direction approaching the second end portion in the circumferential direction and which includes two convex corners, and the second end portion has a recess which is recessed in a direction away from the first end portion in the circumferential direction and which includes two concave corners, wherein the projection of the first end portion engages with the recess of the second end portion so that at least a part of an edge of the projection between the two convex corners contacts with the recess and so that each of the two convex corners face each of the two concave corners with a gap therebetween.

9. The rotating member according to claim 8, wherein the projection has a rectangular shape with the two convex corners, and the recess has a rectangular shape with the two concave corners.

10. The rotating member according to claim 8, wherein the projection has a trapezoidal shape with the two convex corners, tapered in width toward a direction in which the projection projects, and the recess has a trapezoidal shape with the two concave corners, with which the projection engages.

11. The rotating member according to claim 9, wherein the rotating shaft is made of metal.

12. The rotating member according to claim 9, wherein the rotating member is a charging roller that charges an image bearing member for forming an image on the recording medium.

13. The rotating member according to claim 9, wherein each of the two convex corners has a chamfered shape so as to form the gap.

* * * * *